US006007177A

United States Patent [19]

Takanaka et al.

[11] Patent Number: 6,007,177

[45] **Date of Patent: *Dec. 28, 1999**

[54] CAP FOR INK JET RECORDING HEAD WITH RINSING LIQUID SUPPLIED THERETO

[75] Inventors: Yasuyuki Takanaka, Yokohama; Mitsuru Kurata, Kawasaki; Tokihide Ebata, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/563,793

[22] Filed: Nov. 28, 1995

[30] Foreign Application Priority Data

Nov. 30, 1994 [JP] Japan ..... 6-296390
Apr. 7, 1995 [JP] Japan ..... 7-082981

[51] Int. Cl.[6] ..... B41J 2/165
[52] U.S. Cl. ..... 347/28
[58] Field of Search ..... 347/28, 21, 29, 347/31, 22, 90, 30; 15/256.5; 134/170, 186; 101/424, 425, 423; 342/30, 28, 29, 31

[56] References Cited

U.S. PATENT DOCUMENTS

| | | | |
|---|---|---|---|
| 4,959,662 | 9/1990 | Kobayashi | 347/30 |
| 5,552,811 | 9/1996 | Kurata et al. | 347/30 |

FOREIGN PATENT DOCUMENTS

| | | | |
|---|---|---|---|
| 0562786 | 9/1993 | European Pat. Off. . | |
| 0576175 | 12/1993 | European Pat. Off. . | |
| 57-133074 | 8/1982 | Japan . | |
| 59-127768 | 7/1984 | Japan . | |
| 61-185451 | 8/1986 | Japan . | |
| 62-077939 | 4/1987 | Japan . | |
| 63-295265 | 12/1988 | Japan . | |
| 1040340 | 2/1989 | Japan . | |
| 05031905 | 2/1993 | Japan . | |
| 05212851 | 8/1993 | Japan . | |
| 406008461 | 1/1994 | Japan | B41J 2/165 |
| 06071897 | 3/1994 | Japan . | |

*Primary Examiner*—N. Le
*Assistant Examiner*—Thien Tran
*Attorney, Agent, or Firm*—Fitzpatrick, Cella, Harper & Scinto

[57] ABSTRACT

An image formation apparatus comprises a cap to cover the discharge ports of a recording head for discharging ink for the formation of images; rinsing liquid supply means for supplying rinsing liquid for rinsing the cap; and a rinsing liquid receptacle arranged to surround the cap for receiving and retaining the rinsing liquid. With the structure thus arranged, the image formation apparatus is able to prevent ink from being dried in the recording head, and at the same time, to rinse out ink and other dust particles adhering to the discharge port surface of the recording head, and to the cap, a member constituting the device to recover the discharging condition of the apparatus, thus preventing the adhesion of extracted substance resulting from the evaporation of water content in ink for the maintenance of stable ink discharges.

64 Claims, 18 Drawing Sheets

CAP FOR INK JET RECORDING HEAD WITH RINSING LIQUID SUPPLIED THERETO

BACKGROUND OF THE INVENTION

1. Field of the Invention

The present invention relates to an image formation apparatus to form images on a recording medium. More particularly, the invention relates to an image formation apparatus using an ink jet recording head to form images by discharging ink or other liquid, and an information processing system using such apparatus as its output means.

2. Related Background Art

An image formation apparatus used together with a computer, word processor or the like, or used individually, such as a copying machine, printer, facsimile apparatus, is provided with a recording head for the formation of images on a recording medium in the form of sheet or others in accordance with image signals applied to driving the head. Also, the image formation apparatuses are roughly divided into those of serial type and line type depending on the scanning methods of recording head to be used. In the meantime, besides the paper sheet, OHP sheet or other plastic sheets usually adopted as recording media, use of other recording media is demanded, as the materials of recording media, including thin paper, processed paper sheet such as for filing use with a perforation or with a roulette or prepared in an arbitrary configuration, and fabrics. Further, with respect to the sizes of recording media, larger ones are increasingly in demand, including sheets for use of advertizement and fabrics for use of making clothes.

Under the circumstances, the ink jet recording method is utilized more as a method suitably usable as output means of information processing systems, such as a printer serving as output terminal of a copying machine, facsimile apparatus, electronic typewriter, word processor, or work station, or a handy or portable printer adopted for use of personal computers, optical disk units, video units, or the like. The ink jet recording method is to record characters, graphic images, and others by discharging fine ink droplets from nozzles. Therefore, this is an excellent method adoptable as means for outputting highly precise images at high speeds. Also, a recording apparatus to which this method is applicable (hereinafter, referred to also as an ink jet recording apparatus) is of a non-impact type, producing lesser noises, while making it easy to perform recording in colors by use of multiple color ink, and to make the apparatus main body smaller, as well as to form images in higher densities, among other advantages. As a result, this method has been in more demand increasingly in recent years. Here, recording is meant to include the provision of ink or the like (setting, image formation, printing, dyeing, and others) for all the ink carriers that accept the provision of ink, such as cloths, threads, paper, or sheet materials. The ink jet recording method is applicable to the wide range of industrial uses, not only for those fields dealing with information processing, but also, for the apparel industries or the like that deal with fabrics, threads, paper, sheet materials or any others that may accept the provision of ink.

With the ink jet method, a liquid jet apparatus (textile printing apparatus, for example) provides a higher degree of flexibility for printing images to be formed, and also, performs textile printing at lower costs, among other advantages, mainly because unlike the screen printing usually practiced, this apparatus does not need any original plate of images to be printed.

Here, in Japanese Patent Application Laid-Open No. 5-212851, there is disclosed one conventional example of a textile printing apparatus using an ink jet recording method. Particularly, as it is clear from the description of FIG. 2 that accompanies this laid-open application, the textile printing apparatus prints by discharging ink from the nozzle head to the textile medium being carried in the direction perpendicular to the head. In other words, ink is discharged from the nozzles in the horizontal direction. Also, for this printing unit that performs ink discharges, there are provided a printing unit having a nozzle head, and a feeding mechanism having an endless belt, each facing the textile medium being carried between them.

Further, for such printing apparatus, it is structured to enable the printing unit to slide horizontally. Here, it is generally practiced that the printing unit is made shiftable, among other arrangements, for the adjustment of the gap formed between the unit and the textile medium or for the replacement of the endless belts.

In the meantime, for the textile printing apparatus using the ink jet recording method described above, it is equally required to enhance the printing speeds as printing apparatuses used for general purposes.

To implement the enhancement of printing speeds, the most direct and realistic method is to increase the number of ink discharge ports of an ink jet recording head, that is, to make the ink jet head longer, even for the structure that should be arranged for printing on fabrics as described above. Such media are formed comparatively long, necessitating a continuous execution of printing More precisely, the number of discharge ports should be increased and arranged in the feeding direction of fabrics or other recording medium (in other words, the ink jet head should be elongated in the feeding direction), thus increasing the width of one line to be printed more by one scanning of the head. Hence, if only the feeding amount is increased accordingly, it is possible to enhance the printing speeds.

However, as the arrangement direction of the discharge ports of the ink jet head is vertical for the textile printing apparatus disclosed in Japanese Patent Application Laid-Open No. 5-212851, the difference in water head between each of the discharge ports becomes larger when making the ink jet head longer. Such difference in water head between each of the discharge ports results in the difference in discharge amounts of the respective nozzles, thus inviting degradation in the quality of printed images in some cases.

On the other hand, there is known the structure wherein a head discharges ink vertically, the so-called downward head arrangement, as disclosed in Japanese Patent Application Laid-Open No. 5-31905, for example. In accordance with this arrangement, the difference in water head does not exist in principle between each of the discharge ports, because the discharge ports are arranged horizontally. Therefore, such problem affecting the image quality unfavorably can be solved.

Moreover, as another effect obtainable by use of the downward head arrangement, recovery processes can be performed uniformly for all the discharge ports by the application of ink suction or other means because of non-existence of difference in water head described above. Also, with this type of arrangement, it is possible to prevent water droplets or the like that may adhere to the discharge port surface from being driven into the interior of the discharge ports.

As a typical image formation apparatus capable of recording on various kinds of recording media as described above, there is one that uses an ink jet recording head to record by discharging ink from its discharge ports. For the image formation apparatus of serial type where the ink jet recording head scans in the direction intersecting the feeding direction of a recording medium to be used, images are recorded totally on the recording medium by repeating such operation that the ink jet recording head is arranged to scan in accordance with image signals, and discharge ink onto a recording medium after having set the medium in a given position, and then, the recording medium is fed at a given pitch subsequent to each recording scan thus performed. Also, for the image formation apparatus of full line type where an ink jet recording head is fixed on the feeding unit of recording media in order to cover the entire width of a recording medium to be used, recording is performed on the entire surface of the recording medium only by the feeding of the recording medium, while arranging the recording head to discharge ink in accordance with image signals when the recording medium is carried in a position opposite to the discharge port surface on which the discharge ports of the ink jet recording head are formed.

The image formation apparatus using an ink jet recording head of the kind tends to present difficulty in performing stable ink discharges due to overly viscous ink brought about by the evaporation of water content in ink in the discharge ports or the gradual creation of ink clogging or the like. To maintain stable ink discharges, therefore, recovery means is provided to remove such difficulty. As recovery means, there is known capping means for minimizing the causes for ink to become overly viscous by capping the discharge port surface of the ink jet recording head while recording is at rest or predischarge means for removing such overly viscous ink by discharging ink as needed, apart from the regular discharges for recording. However, even when the recording head is capped by capping means, it is inevitable that the viscosity of ink advances slowly. Therefore, ink is fed to the recording head by the application of pressure as required so as to forcibly exhaust ink to the interior of capping means. For this purpose, an ink absorbent is provided for capping means or predischarge means for the intended absorption of overly viscous ink exhausted from the recording head. To such absorbent, ink discharged or forced out from the recording head is absorbed.

Further, in Japanese Patent Application Laid-Open No. 6-71897, a recovery method is disclosed, wherein the jet of rinsing liquid is emitted from outside onto an ink jet recording head to clean off ink adhering to the discharge port surface.

However, for the conventional image formation apparatus described above, ink adhering to the discharge port surface is transferred to capping means, and then, the adhesion of ink occurs on it when the discharge port surface of the ink jet recording head is capped with the member that constitutes capping means. Consequently, when a specific ink is used, the water content in ink adhering to the capping means is evaporated due to the change of its chemical properties as the time elapses if the ink is left intact in such condition for a long time. Then, dyes, the main composition thereof, are extracted and deposited on the capping means ultimately. As a result, this extracted substance adheres to the circumference of the ink jet recording head, thus clogging the interior of the discharge ports, or the aperture of capping means when the ink jet recording head is again capped. Further, such extracted substances become nuclei themselves to invite dust particles or dirt in the atmosphere and cause them to adhere to the capping means. Therefore, the contamination of capping means is advances.

The same phenomenon occurs with respect to the absorbent provided for the interior of capping means or predischarge means. In other words, along the evaporation of water content in ink retained in the absorbent, dyes are extracted into the absorbent. By this extracted substance, its ink absorbing function is spoiled after all. A contamination of the kind that concurs in recovery means often deteriorates the recovering capability of an ink jet recording head, and, in turn, the contaminated recovery means invites the adhesion of such contaminated particles to the recording head. Consequently, it becomes impossible to maintain stable discharges of ink after all.

Also, even with the method wherein ink adhering to an ink jet recording head is cleaned off by means of the jet of rinsing liquid emitted onto the discharge port surface, no means is provided for rinsing out the recovery means at all. Therefore, it is impossible to prevent recovery means from being contaminated eventually. The problems described above still remains unsolved when adopting this method effectively for practical use.

SUMMARY OF THE INVENTION

It is an object of the present invention to provide an image formation apparatus capable of suppressing the creation of extracted substance due to drying of ink that adheres to recovery means so as to maintain the recovering function of recovery means and the stable discharging condition of a recording head, and to provide an information processing system using such apparatus as its output means.

It is another object of the invention to provide an image formation apparatus provided with a cap to cover the discharge ports for the formation of images by discharging ink from such ports; rinsing liquid supply means for supplying rinsing liquid to the cap for rinsing it out; and a rinsing liquid receptacle arranged surrounding the cap to receive the rinsing liquid thus supplied, and to provide an information processing system using such apparatus as its output means.

In accordance with the present invention, the image formation apparatus is provided with a cap member having an absorbent installed in it. Therefore, when recording is at rest, the formation surface of the discharge ports of the recording head is airtightly closed (capped) by the cap member for the prevention of ink from being dried in the interior of the discharge ports. Also, ink is forced out from the recording head as required in order to exhaust any overly viscous ink in the discharge ports. Therefore, ink often adheres to the portion of the cap member that contacts the recording head, and the absorbent as well. Thus such adhesion of ink cause them to be contaminated when the recording head is covered by the cap member, and also, when ink is forced out from the recording head. Here, if rinsing liquid is supplied to the absorbent by use of rinsing liquid supply means in a state that the cap member is released from capping, the rinsing liquid is absorbed by the absorbent to make the concentration of ink lower. Further, if the supply of rinsing liquid is set at an amount substantially equal to the inner volume of the cap member, the concentration of ink adhering to the interior of the cap member, including the portion of the cap member that contacts the recording head, is also made lower. After that, by use of suction means, the liquid that resides in the cap member is exhausted to the outside. In this way, the ink that has been absorbed to the absorbent, as well as ink that adheres to the interior of the cap member, is exhausted together with the rinsing liquid. As a result, both the absorbent and the cap member are rinsed out simultaneously.

Also, for the cap member, communicating means is provided to conductively connect its interior with the outside. Therefore, when the recording head is capped by the cap member, it is possible to maintain pressure in the gap formed by the cap member and the recording head at a constant level, thus preventing the air and liquid in the cap member from flowing reversely into the discharge ports of the recording head. With communicating means, particularly the one having means for opening and closing it arbitrarily, it is possible to maintain the airtightly closed condition with respect to the discharge port surface by use of this opening and closing means after the capping operation is completed. Thus ink in the discharge ports is prevented from being dried efficiently.

Further, on the circumference of the cap member, a receptacle is formed to receive liquid in a position lower than the contact surface between the cap member and the recording head Therefore, the rinsing liquid overflows from the cap member if only the amount of rinsing liquid supplied form rinsing liquid supply means is made more than the inner volume of the cap member. In this way, the external side of the cap member is rinsed out, too. The rinsing liquid that overflows from the cap member is retained in the receptacle. However, since exhausting means is provided for the receptacle to exhaust the liquid from the receptacle, there is no possibility that liquid overflows from the receptacle at all.

In this case, a second absorbent is provided for absorbing liquid outside the cap member, and if any forced-out ink from the recording head should be caused to flow outside the cap member, this second absorbent functions to absorb such deviated flow of forced-out ink. Here, since the other end of the second absorbent is immersed in the liquid retained by the receptacle, ink absorbed thereby is conducted to the receptacle by means of the water head created in the second absorbent, thus minimizing the resultant stains on the cap member due to ink that has flown outside the cap member. Also, if the stains thus brought about should become conspicuous, the rinsing liquid to be supplied from rinsing liquid supply means is caused to overflow from the cap member. Then, because of the difference in water head thus created, the flow of rinsing liquid takes place to rinse out the second absorbent.

In addition, for the predischarge unit having an absorbent in it, such absorbent is installed in the liquid retaining portion. Therefore, while the rinsing liquid is being supplied from rinsing liquid supply means into the liquid retaining portion, the liquid retained in that portion is being flown out by exhausting means. In this way, the absorbent in the predischarge unit is rinsed out in the same way as the absorbent provided for the cap member as described above.

In this case, the rinsing liquid supply means and exhausting means are arranged in the positions facing each other with the absorbent being placed between them. Thus the rinsing liquid supplied from the rinsing liquid supply means is exhausted by the exhausting means by way of the absorbent reliably, thus effectuating the rising of the absorbent efficiently.

Also, if a rinsing liquid release unit is arranged at a position higher than capping means in order to release the liquid into capping means, it is possible to pour the rinsing liquid over the surface opposite to the jet head of the capping means. Here, if the liquid retaining portion is positioned higher for rinsing liquid than the cap member and the rinsing liquid release unit as well, it becomes easier for to supply the rinsing liquid to rinsing means, and at the same time, any contamination of the liquid retaining portion is prevented from being brought about by the revere flow of rinsing liquid. Therefore, it is possible to avoid the mixture of ink colors that may be caused in capping means for each of liquid jet heads, and enhance the performance of recovery means without increasing costs required for the provision of a liquid jet recording apparatus capable of maintaining the recovering function of recovery means and the stable discharges of the recording head to eliminate defective operation of the recording head, and also, an information processing system using such apparatus as its output means.

DETAILED DESCRIPTION OF THE PREFERRED EMBODIMENTS

Hereinafter, with reference to the accompanying drawings, the description will be made of the embodiments in accordance with the present invention.

First Embodiment

Figure 1:
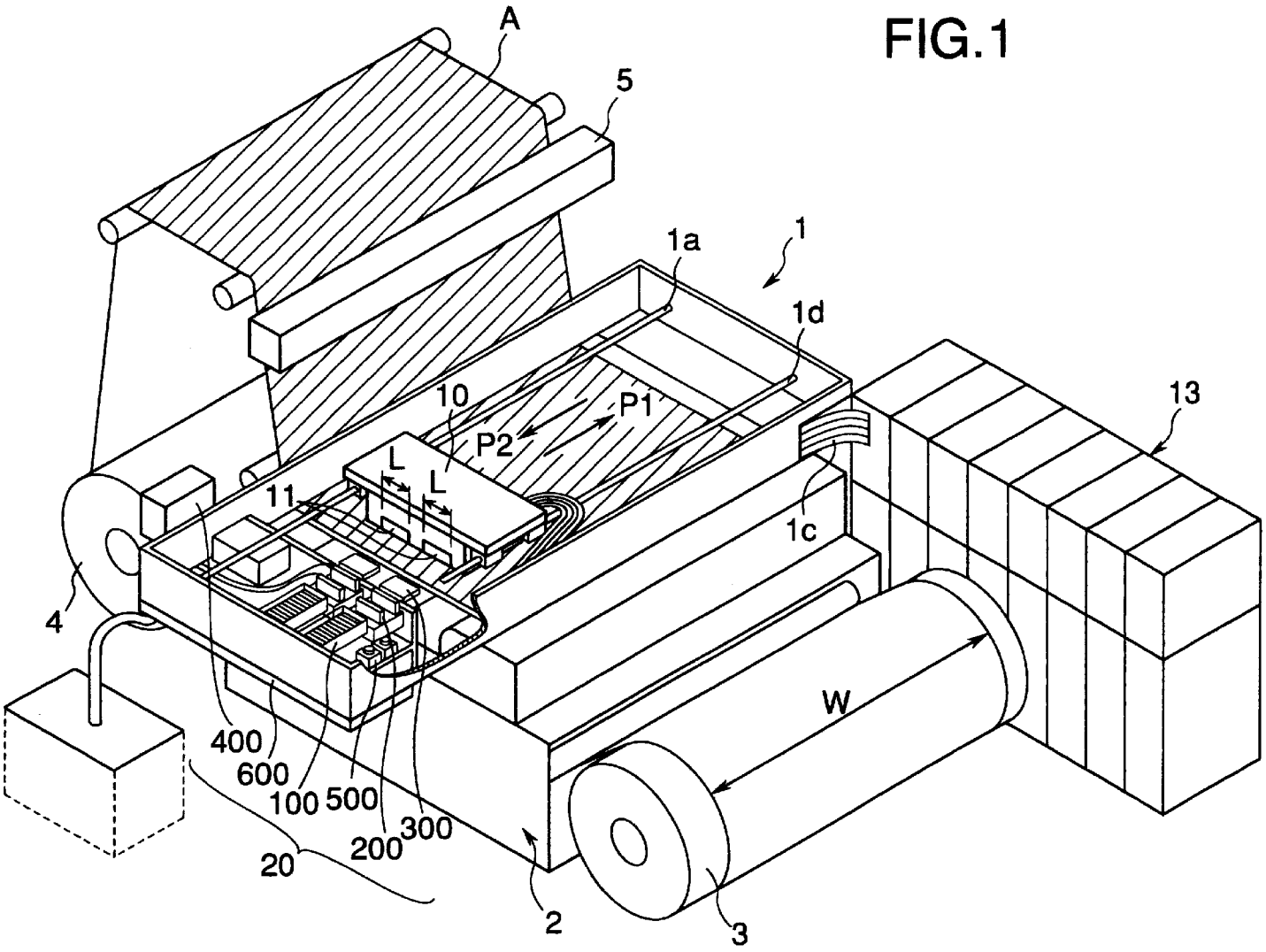
FIG. 1 is a perspective view which schematically shows one embodiment of an image formation apparatus in accordance with the present invention.
Figure 2:
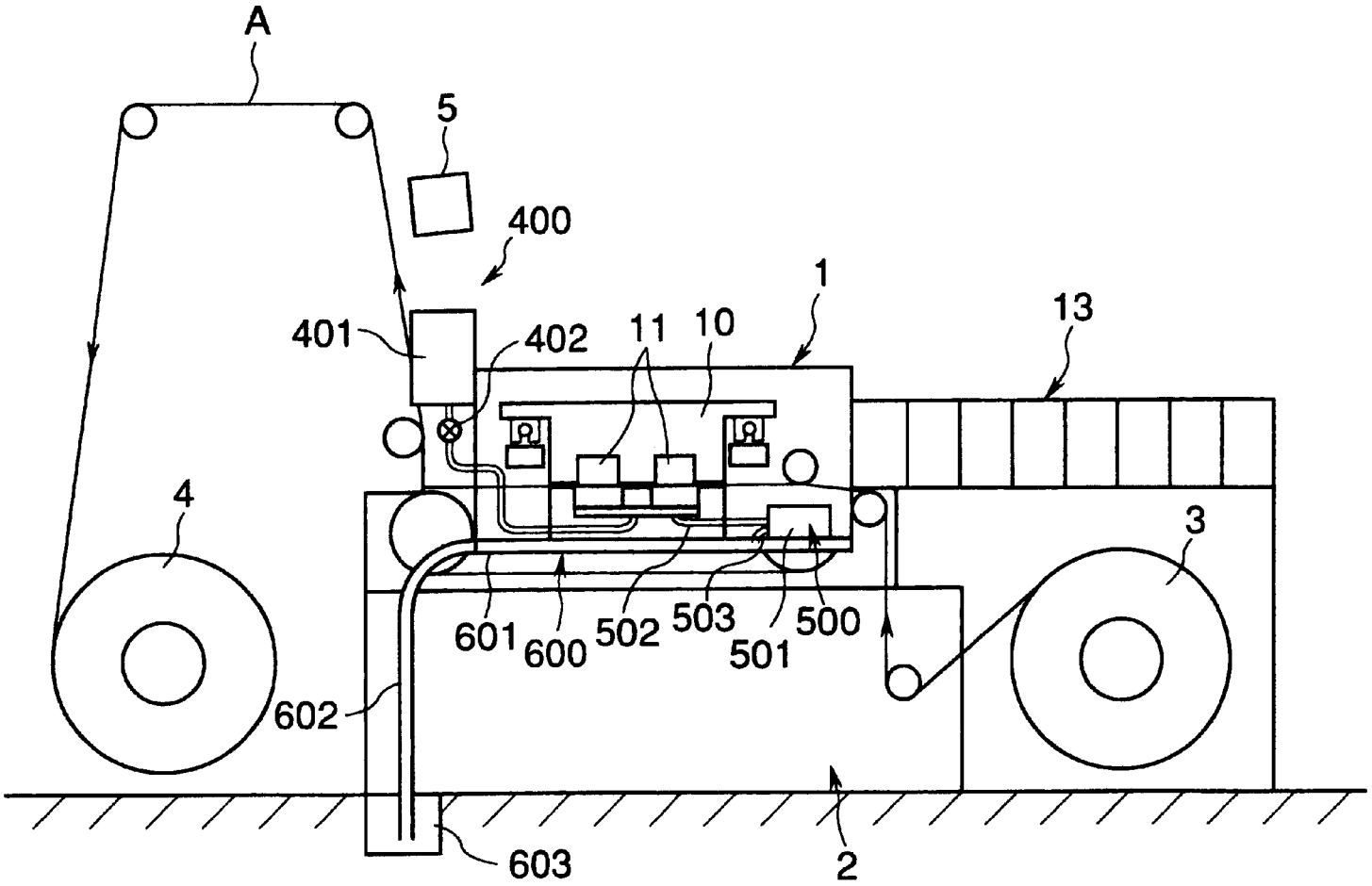
FIG. 2 is a cross-sectional view which shows the principal part of the image formation apparatus represented in FIG. 1.

FIG. 1 is a perspective view schematically showing one embodiment of an image formation apparatus in accordance with the present invention. FIG. 2 is a cross-sectional view which shows the principal part of the image formation apparatus represented in FIG. 1.

The image formation apparatus of the present embodiment is to discharge ink downwardly, comprising a printer unit 1 for recording images on a recording medium A and a feed unit 2 for intermittently feeding the recording medium A only for a given amount (that is, a recording length L). The recording medium A is a fabric, and wound in a roll, which is held in a let out unit 3. The structure is arranged to feed the medium by means of the feed unit 2 to the printing unit 1; the recording medium A is dried in a drying unit 5, after recording is made in the printer unit 1; and it is wound and stored in a winding unit 4.

In the printer unit 1, two scanning rails 1*a* and 1*b* are supported in the direction perpendicular to the feeding direction of the recording medium A. On the two scanning rails 1*a* and 1*b*, a carriage 10 is slidably supported with a total of 16 recording heads, eight each on the up stream side and down stream side with respect to the feeding direction of the recording medium A, respectively. The carriage 10 is driven by a driving source (not shown) to scan reciprocally in the directions indicated by arrows P1 and P2. By one scan of the carriage 10, recording is performed by means of the recording head 11 in the range of the recording length L× the width of the recording medium A. The recording medium A is intermittently fed per scan. In this way, recording is performed continuously in order on the recording medium A. The recording method is such that image data are divided and allocated to the recording head 11 on the up stream side and the recording head 11 on the down stream side of the feeding direction of a recording medium A by 50% each for recording, and then, the images recorded by both of them are superposed. In other words, a 50% of the image data are recorded by the recording head 11 on the up stream side, and after the recording medium A is intermittently fed, another 50% of the image data are recorded by the recording head 11 on the down stream side.

Also, as the recording heads 11, recording heads of ink jet recording type are used for recording by discharging ink. Of the recording heads 11, the eight recording heads 11 arranged on the same side as the recording medium A with respect to its feeding direction are to discharge ink of eight colors each having different hue, saturation, and luminance. Such ink of difference color is supplied from the ink supply device provided with eight ink tanks each retaining ink of different color through the respective tubes by use of supply pumps (not shown) each arranged for the respective tanks. Also, ink of the same color is supplied, respectively, to each of the recording heads 11 on the down stream side arranged in the position corresponding to the recording heads 11 on the up stream side, In this respect, ink is automatically supplied at the time of recording to each of the heads by capillary function just for the portion of ink to be discharged by the respective recording heads 11.

Figure 3:
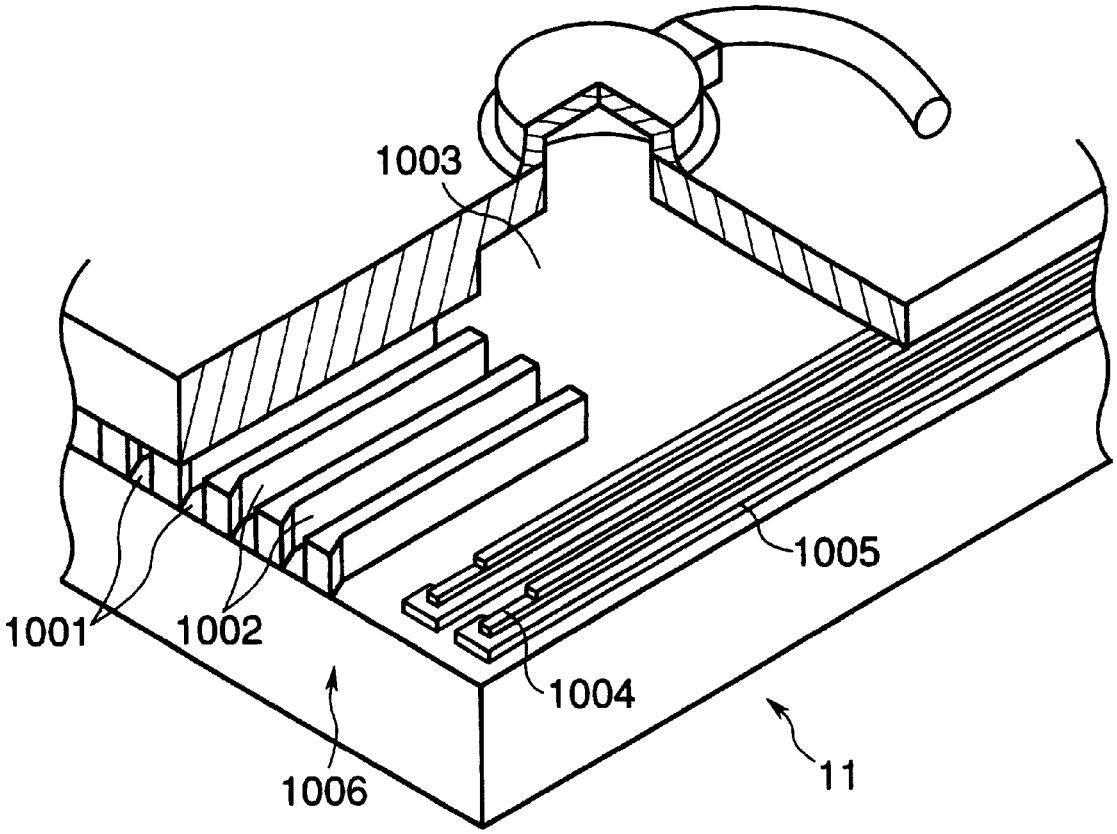
FIG. 3 is a perspective view which shows the inner structure of the elemental head of a recording head used for the image formation apparatus represented in FIG. 1.

Here, with reference to FIG. 3, the inner structure of a recording head 11 will be described. For the recording head, a plurality of discharge ports 1001 are formed at specific pitches on the discharge port surface 1006 facing a recording medium A. Also, each of the discharge ports 1001 is conductively connected to a common liquid chamber 1003 through each of liquid paths 1002. Each liquid path 1002 is provided with an energy generating means 1004 that generates energy for use of ink discharge when voltage is applied through an electrode 1005. The common liquid chamber 1003 is conductively connected to the ink tank described above. The common liquid chamber 1003 is arranged to receive the ink supply form the ink tank. Ink supplied to the common liquid chamber 1003 from the ink tank and retained in it temporarily enters the liquid paths 1002 by means of capillary phenomenon and forms meniscus at the discharge ports 1001, thus maintaining the liquid paths 1002 in a state of being filled in with the ink. When the energy generating means 1004 is energized in this state, ink is discharged from the discharge ports 1001 due to the energy thus generated.

As the energy generating means 1004, there are adoptable, among others, electromechanical transducing elements such as piezo elements that generate mechanical energy to exert discharge pressure instantaneously; those discharging ink by action of heat generated by the irradiation of electromagnetic waves, such as laser; or electrothermal transducing elements, such as heat generating elements provided with heat generating resistors, to give thermal energy to ink, and discharge ink by the application of such thermal energy.

Of those described above, the elements that discharge ink by the application of thermal energy are capable of arranging the discharge ports 1001 in high density to make a high resolution recording possible. Particularly, for those using electrothermal transducing elements as energy generating means 1004, it is possible to apply the semiconductor manufacturing processes to the fabrication of energy generating means 1004. Therefore, the elements can be made compactly. At the same time, the advantages of the IC technologies and micro-machining techniques, whose advancement and reliability have been significantly enhanced in the semiconductor industries in recent years, can be fully utilized for the easier assembling of the elements in high density at lower manufacturing costs.

Now, reverting to the description of an image formation apparatus of the present embodiment with reference to FIG. 1 and FIG. 2. For the printer unit 1, a recovery device 20 is arranged for the maintenance of the discharge characteristics of the recording heads 11 in good condition outside the area where the reciprocal motion is conducted to operate recording. The recovery device 20 comprises a cap unit 100, blade unit 200, predischarge unit 300, tank unit 400, pump unit 500, and exhaust unit 600. Hereunder, each of these units is described in detail.

(1) Cap unit 100

If the discharge port surface 1006 of the recording head is exposed and left intact in the air, water content in ink is evaporated to make the ink overly viscous in the liquid paths 1002 of the recording head 11, resulting in unstable discharges. The cap unit 100 is to effectuate the prevention of this evaporation, and provided with the function to cap the discharge port surface 1006 when recording is at rest. However, if the head is left intact for a long time, the water content in ink is evaporated to make the ink overly viscous in the liquid paths 1002 slowly even when it is capped. Further, air bubbles residing in the liquid paths 1002 and the common liquid chamber 1003 are caused to grow larger to hinder stable discharges in some cases. Therefore, the cap unit 100 is also provided with a function to force out the overly viscous ink and air bubbles from the discharge ports 1001 in a state that the discharge port surface 1006 is released (capping is released) by driving the supply pump arranged in the ink supply device 13 described earlier.

Figure 4:
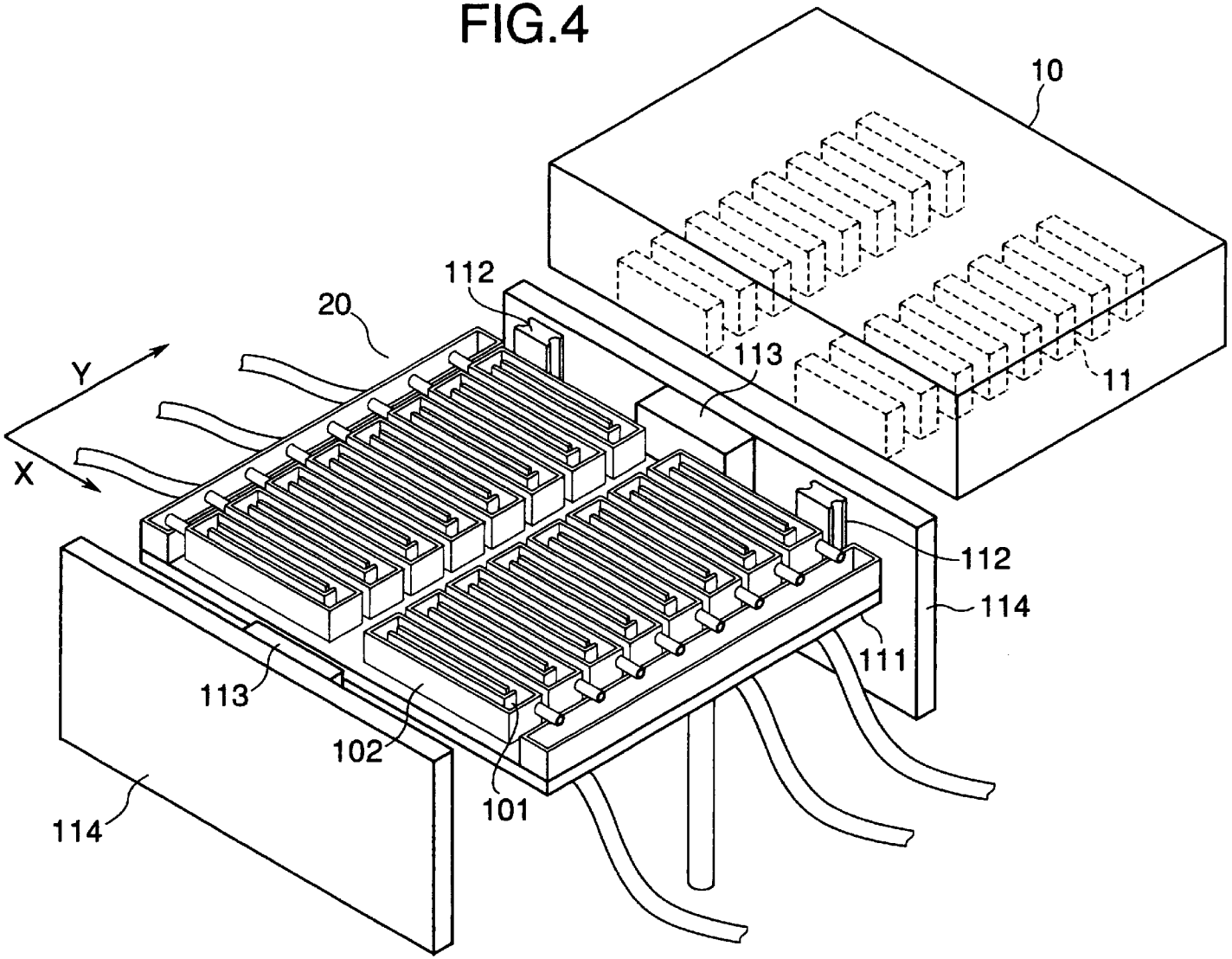
FIG. 4 is an enlarged perspective view which shows the cap unit of the image information apparatus represented in FIG. 1.

FIG. 4 is an enlarged perspective view which shows the cap unit of the image formation apparatus represented in FIG. 1. The cap unit 100 is arranged to face the recording head 11 at the home position of the carriage 10. As shown in FIG. 4, the cap unit is provided with a supporting board 111 having sixteen holders 102 on it, each arranged corresponding to the position of each recording head 11. Also, in each of the holders 102, the cap 101 is installed for capping each recording head 11. The supporting board 111 is movably supported in the up and down directions by two side boards 114 having guide rails 112, respectively. On the side boards 114, air cylinders 113 are installed, respectively, to effectuate the vertical movement of the supporting board 111. It is, then, arranged that when the supporting board 111 is driven by the air cylinders 113 to move in the up and down directions, the discharge port surface 1006 of each recording head 11 is capped by each of the caps 101. Each cap 101 is formed by an elastic material, such as fluoro, silicone, or chlorinated butyl rubber, to enhance the close contact and airtightness with each recording head 11 at the time of capping.

Figure 5:
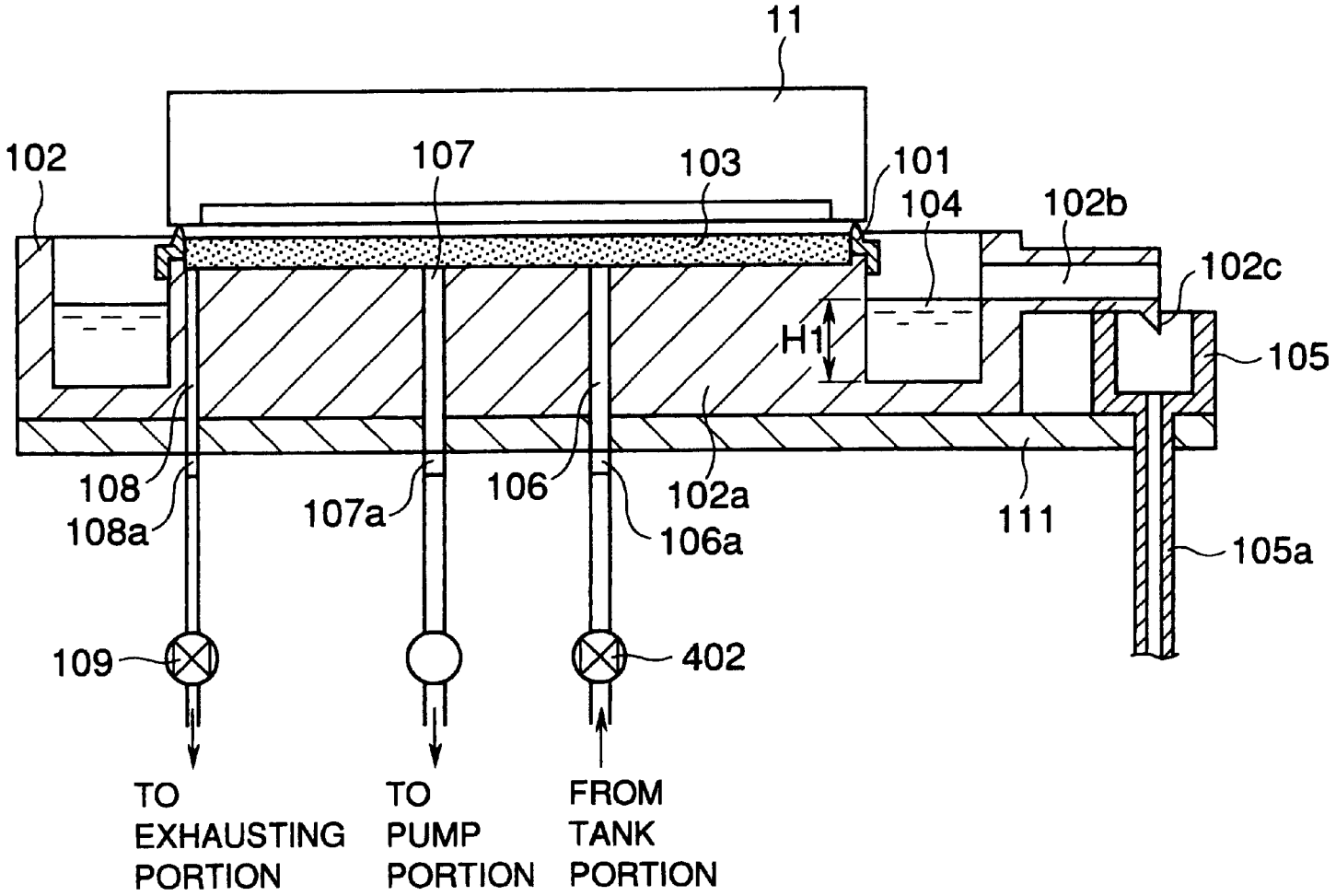
FIG. 5 is a cross-sectional view which shows the vicinity of a holder of the cap unit represented in FIG. 4, taken in the direction X.
Figure 6:
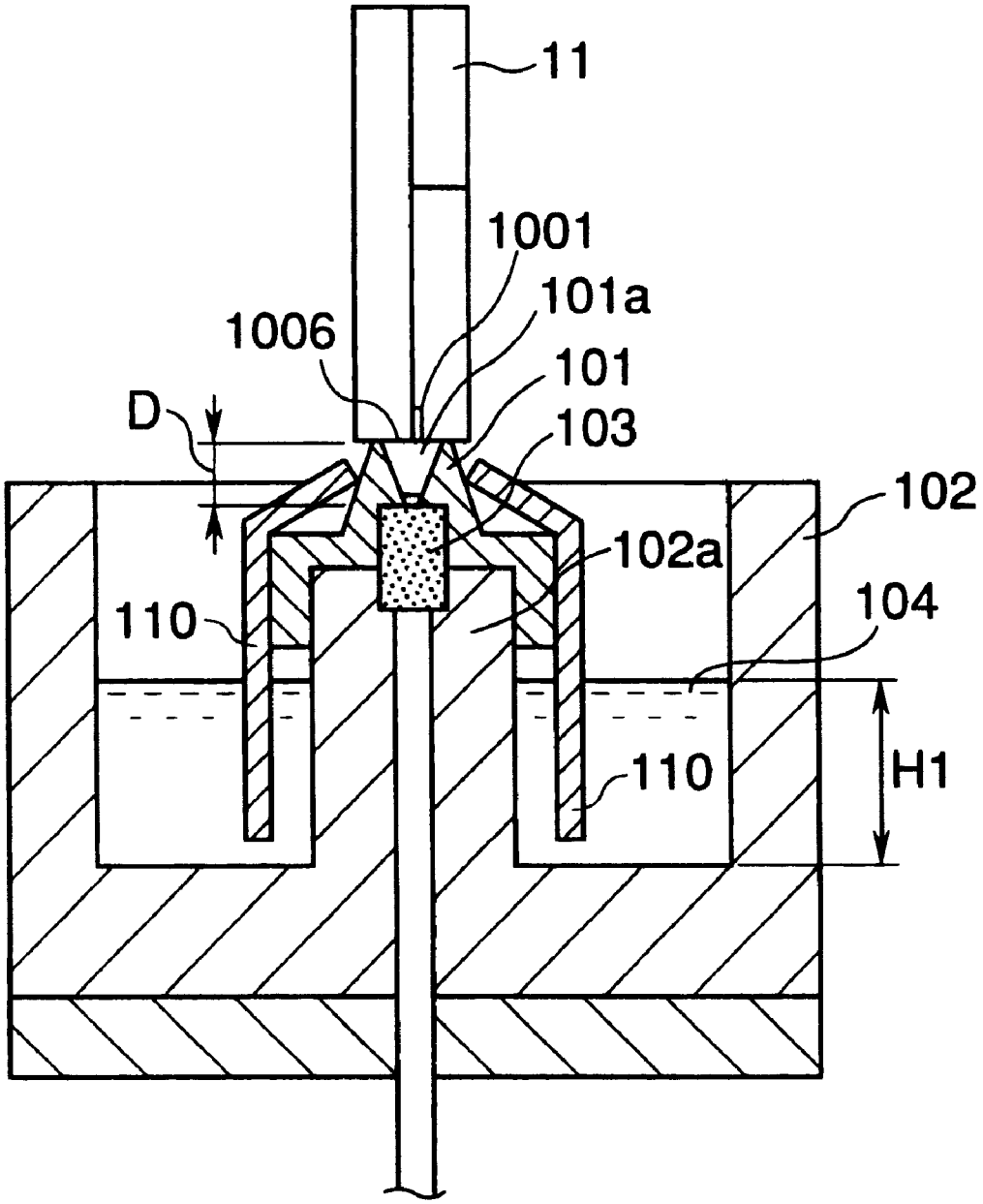
FIG. 6 is a cross-sectional view which shows the vicinity of a holder of the cap unit represented in FIG. 4, taken in the direction Y.

FIG. 5 is a cross-sectional view which shows the vicinity of the holder of the cap unit 20 represented in FIG. 4, taken in the direction X (longitudinal direction of the holder 102). FIG. 6 is a cross-sectional view which shows the vicinity of the holder likewise, taken in the direction Y (shorter side direction of the holder 102). Each of them illustrates the state where the recording head 11 is capped, respectively.

As shown in FIG. 5 and FIG. 6, the cap 101 is fixed to a cap mounting section 102*a* of the holder 102. In the cap 101, an absorbent 103 formed by foam urethane, sintered compact, textile net, or other porous material is installed. The absorbent 103 is fixed to the holder 102, and at the time of capping, it forms a gap D with the recording head 11. The absorbent 103 holds liquid thereby to maintain the interior of the cap 101 at high humidity, hence suppressing the evaporation of water content of ink in the recording head 11 to minimize ink to become overly viscous. Liquid held by the absorbent 103 is the ink that has been forced out from the discharge port 1001. Also, it is the rinsing liquid that has been used for rinsing the interior of the cap 101. Here, the ink absorbent 103 sucks from the discharge port surface 1006 the ink droplets adhering to the discharge port surface 1006 because of the ink that has been forced out from the discharge ports 1001 by the pressurized ink feed. In this way, the ink droplets are brought into the cap 101 rapidly.

On the circumference of the cap mounting section 102*a* of the holder 102, the receptacle 104 is formed in the position lower than the cap 101. The receptacle 104 retains ink, rinsing liquid, or the mixed liquid thereof, while maintaining a specific liquid level H1. Any liquid exceeding the liquid level H1 is exhausted to a liquid collector 105 through a drain 102*b* arranged at the end portion of the holder 102. The liquid collector 105 collects liquid from each of the holders 102 to let it out to the exhaust unit 600 (see FIG. 1) through the exhaust pipe 105*a* serving as exhausting means for exhausting liquid in the receptacle 104. The leading end 102*c* of the drain 102*b* is formed to be an acutely angled extrusion. It guides liquid flowing in the drain 102*b* to the liquid collector 105 and prevents the liquid from wheeling around the drain 102*b* due to the surface tension of the liquid.

On the surface of cap mounting section 102*a* of the holder 102, where the absorbent 103 is installed, a liquid supply port 106, suction port 107, and conducting port 108 are opened.

The liquid supply port 106 is to supply rinsing liquid into the cap 101, and connected to the tank unit 400 (see FIG. 1) by means of joint 106*a*. The rinsing liquid is supplied through an electromagnetic valve 402. In other words, rinsing liquid supply means is constituted by this liquid supply port 106 and the tank unit 400 for supplying rinsing liquid into the cap unit.

The suction port 107 is to let out liquid from the interior of the cap 101. It is connected to the pump unit 500 (see FIG. 1) by means of a joint 107*a*. By the function of the pump unit 500, liquid in the cap 101 is sucked. In other words, suction means is constituted by this suction port 107 and the pump unit 500 for sucking liquid from the cap to exhaust it to the outside.

The conducting port 108 is arranged as conducting means for communicating the interior of the cap 101 conductively with the outside. It is connected to the exhaust unit 600 (see FIG. 1) by means of a joint 108*a*. For the pipe connecting the conducting port 108 and the exhaust unit 600, an electromagnetic valve 109 is provided as opening and closing means to open or close the conducting means arbitrarily. The electromagnetic valve 109 is opened when the recording head 11 is capped with the cap 101 to effectuate capping, thus allowing the air and liquid in the cap 101 to escape to the exhaust unit 600. In this way, the cap 101 is compressed by capping so as to suppress the pressure rise in the cap 101 and prevent the air and liquid in the cap 101 from reversely flowing into the discharge ports 1001 of the recording head 11. After capping is completed, the electromagnetic valve 109 is closed to keep the cap 101 to reside in a state that it is airtightly closed.

The connections are made between the liquid supply port 106 and tank unit 400, between the suction port 107 and pump unit 500, and between the conducting port 108 and exhaust unit 600 by means of joints 106*a*, 107*a*, and 108*a*, respectively, as described above. Therefore, when replacing holder 102, it is possible to disconnect it from these joints 106*a*, 107*a*, and 108*a*, and exchange holders 102 easily. Further, as shown in FIG. 6, a second absorbent 110 is installed on the external side of the cap 101. On the end portion (upper end) of this absorbent is positioned near the contacting portion between the cap 101 and recording head 11, and the other end (lower end) of the absorbent is positioned to be immersed in the liquid retained in the receptacle 104.

Now, the operation of capping unit 100 will be described.

Figure 7:
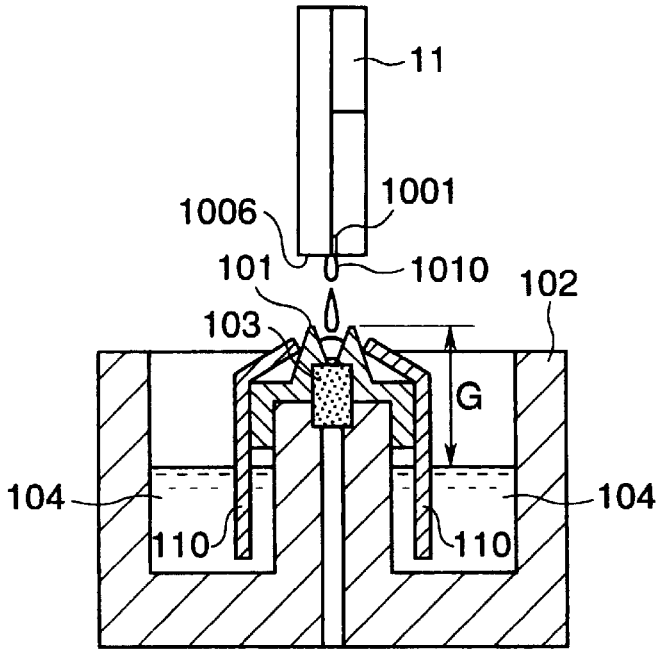
FIG. 7 is a view which illustrates the operation of the cap unit represented in FIG. 4, showing a state of pressurized supply of ink.

Separately from recording by use of the recording head 11, a pressurized ink feed is performed at the starting time of recording or per given number of reciprocations at the time of recording (usually, 50 to 100 reciprocations each) in order to force out the overly viscous ink in the recording head 11. As shown in FIG. 7, this pressurized ink feed is to exhaust the overly viscous ink and remaining air bubbles in the discharge ports 1001 to the cap 101 from the discharge ports 1001 by driving the supply pump of the ink supply device 13 (see FIG. 1), while the recording head 11 is positioned to face the cap 101 in a state that both of them are apart from each other. This operation is effective in rinsing out the dust particles or the like that may adhere to the surface of discharge ports 1001 or residing in the discharge ports 1001 so as to maintain the stable discharges.

After the completion of the pressurized ink feed, most of the ink droplets 1010 formed on the discharge port surface 1006 drop off by its own weight, which are absorbed by the absorbent 103. However, a part of such ink droplets still remains adhering to the discharge port surface 1006 together with small ink droplets. Therefore, as shown in FIG. 6, the recording head 11 is once capped with the cap 101 for capping in order to absorb ink adhering to the discharge port surface 1006 by use of the absorbent 103. This operation is needed, particularly when the ink whose surface tension is low, and wettability is high when it adheres to the discharge port surface 1006. Depending on the physical properties of ink to be used, the performance of this operation is not necessarily needed from the viewpoint of obtaining a shorter operational time. In this respect, the electromagnetic valve 109 is provided for the operation of capping as described earlier.

Figure 8:
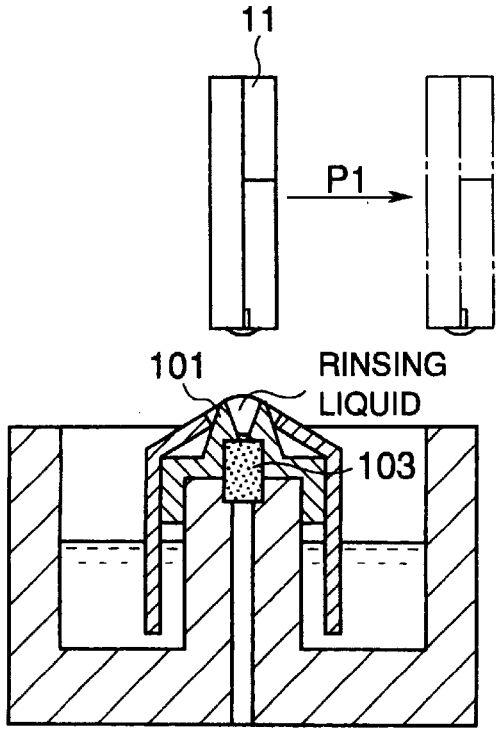
FIG. 8 is a view which illustrates the operation of the cap unit represented in FIG. 4, showing a state of the cap being rinsed out.

Subsequent to the operation described above, the capping by use of the cap 101 is released as shown in FIG. 8. The recording head 11 moves in the direction indicated by an arrow P1 to position it on the blade unit 200 (see FIG. 1). At the same time, the operation is performed with respect to the cap 101 for rinsing the absorbent 103 that has absorbed the forced-out ink by the pressurized ink feed as described above. In other words, the electromagnetic valve 402 (see FIG. 5) is opened to supply rinsing liquid from the tank unit 400 (see FIG. 1) to the interior of the cap 101 from under through the liquid supply port 106. As the kind of rinsing liquid, it is suitable to adopt the liquid used as ink solvent, pure water, a colorless clear ink or the like having the same chemical composition as that of the ink to be used but not containing any dyes in it.

The amounts of rinsing liquid supply to the cap 101 vary depending on the degrees of its contamination, but are roughly divided into the following two:

(1) If the recording head 11 is shorter and the number of its discharge ports 1001 is smaller, thus the exhausted amount of ink being small or if the surface tension of ink to be used is high and its wettability is low on the cap 101, the amount of rinsing liquid supply is set to be almost the same as the inner volume of the cap 101, and then, the inner wall face of the cap 101 is rinsed.

(2) If the recording head 11 is longer, and the number of discharge ports 1001 is larger, thus the amount of ink to be exhausted being large or if the surface tension of ink to be used is low to make the wettability high on the cap 101, the amount of rinsing liquid supply is set to be more than the inner volume of the cap 101, and the contact portion of the cap 101 with the recording head 11, as well as the outer circumference of the cap is rinsed by allowing the rinsing liquid to overflow from the cap 101.

From the viewpoint of the dissipation of rinsing liquid, it is preferable to make it as small as possible. Therefore, the rinsing operation that needs a large amount of rinsing liquid as in the paragraph (2) should be performed only when it is necessary. Since the recording heads 11 and caps 101 are arranged to face one to one, it may be possible to increase the amount of rinsing liquid supply only for the corresponding recording head 11 that use the specific kind of ink, for example, among other means to cope with the situation.

Subsequent to having supplied rinsing liquid, liquid in the cap 101 and liquid retained in the absorbent 103 are sucked from the suction port 107 by means of the pump unit 500 (see FIG. 1), and exhausted to the exhaust unit 600 ultimately. With the operation of this suction, the absorbent 103 is kept in an appropriately moistened condition.

Liquid sucked by this suction is a mixture of the rinsing liquid supplied from the liquid supply port 106 and ink discharged from the recording head 11. As a result, ink is exhausted together with the rinsing liquid when this mixture f liquid is thus sucked. In other words, the concentration of dyes in ink adhering to the cap 101, and in ink sucked by the absorbent 103 is made weaker. Consequently, the inner wall of the cap 101 and the absorbent 103 are rinsed out. Further, when a large amount of rinsing liquid is supplied as in the description (2) above, ink is caused to flow out of the cap 101 together with the rinsing liquid thus applied. As a result, the external wall of the cap 101 is also rinsed out. Therefore, the extraction of dyes in ink to the cap 101 and absorbent 103 is suppressed in rinsing the cap 101 and absorbent 103. Also, even if the extracted substance is deposited, it is possible to dissolve such substance in the rinsing liquid or wash it away by supplying the rinsing liquid.

In this way, it is possible to suppress the deterioration of the recovery function due to the deposition of the extracted substance on the cap 101 and absorbent 103, and also, prevent the extracted substance from adhering to each recording head 11 due to the performance of capping, thus maintaining the stable discharges of ink from each of the recording heads 11.

Meanwhile, the absorbent 110 installed outside the cap 101 absorbs ink if the ink droplet 1010 does not drop into the cap 101 but onto the outside thereof when these are caused to drop off. Moreover, the lower end portion of the absorbent 110 is immersed in the liquid in the receptacle 104 as described earlier. Therefore, with the difference G in water head created in the absorbent 110, ink is guided into the receptacle 104. In this way, it is possible to prevent dyes in ink from being extracted outside the cap 101, particularly in the vicinity of the contacting portion between the cap and recording head 11. Also, the absorbent 110 is able to guide rinsing liquid to the receptacle 104 together with ink by means of this difference G in water head even when the rinsing liquid is supplied until it is overflown to make the rinsing of the absorbent 110 possible.

(2) Blade unit 200

In recording, ink mist is generated. It adheres to the discharge port surface 1006. If this adhering mist approaches the discharge ports 1001, the discharges are made unstable. Also, the ink droplets on the discharge port surface 1006 cannot be absorbed completely, even if the absorption is intended by use of the absorbent 103 of the cap unit 100 subsequent to the pressurized ink feed. The remaining ink droplets, too, may cause unstable discharges. The blade unit 200 is to wipe off the discharge port surface 1006 for cleaning in order to prevent unstable discharges from being caused by the adhesion of ink mist or the like to the discharge port surface 1006. This unit is positioned more on the recording area side than the cap unit 100.

Figure 9:
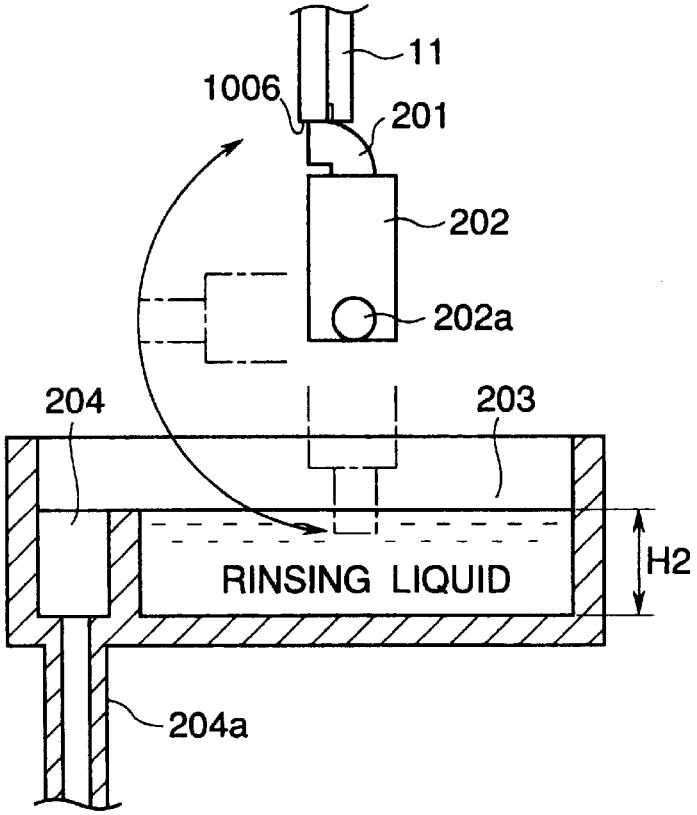
FIG. 9 is a cross-sectional view which shows the blade unit of the image formation apparatus represented in FIG. 1.

FIG. 9 is a cross-sectional view which shows the structure of the blade unit 200 represented in FIG. 1. As shown in FIG. 9, a blade 201 is fixed to the leading end of the holder 202, which rotates in the direction indicated by an arrow centering on a pivot 202*a*. The blade 201 is formed by the same porous material as the absorbent 103 of the cap unit 100. When the holder 202 is positioned as indicated by solid line in FIG. 9, it is pressed to the discharge port surface 1006 of the recording head 11. In other words, the structure is arranged to wipe the discharge prot surface 1006 of the recording head 11 with the blade 201 for wiping when the holder 202 rotates to position the recording head 11 above the pivot 202*a*.

Below the holder 202, a rinsing tank 203 is arranged. The rinsing tank 203 is to rinse the blade 201 after wiping is conducted for the recording head 11. In this tank, rinsing liquid appropriately supplied from the tank unit 400 (see FIG. 1) is retained. Any excessive supply of the rinsing liquid overflows from a drain 204. It is exhausted to the exhaust unit 600 (see FIG. 1) through an exhaust pipe 204*a*. With the arrangement of this drain 204, the liquid level H2 of the rinsing tank 203 is kept at a specific height. After wiping, the holder 202 rotates to position the blade 201 downward, thus enabling the blade 201 to be immersed in and rinsed by the rinsing liquid maintained in a constant amount.

The wiping operation is executed without fail subsequent to each pressurized ink feed described earlier. Also, per reciprocation of the recording head 11 or per a predetermined number of reciprocations thereof, the wiping operation is performed. In accordance with the present embodiment, it is arranged that four recording heads 11 are allocated to one blade 201 for wiping. Also, the blade 201 is connected to the pump unit 500 (see FIG. 1), and by use of the pump unit 500, it is possible to maintain the blade 201 in an appropriately moistened condition by sucking any rinsing liquid that has been excessively absorbed when the blade is immersed in the rinsing liquid retained in the rinsing tank 203. Therefore, wiping is perfectly executed for each of recording heads 11.

(3) Predischarge unit 300

When the duty is low for an image to be recorded, there are some discharge ports 1001 rarely required to discharge, leading to the creation of overly viscous ink due to the evaporation of its water content in some cases. In order to prevent this, specific driving pulses are applied by the predischarge unit 300 to such recording head 11 before start of recording so as to cause ink to be discharged from all the discharge ports 1001 (this operation being called "predischarge"). Also, with wiping by means of the blade unit 200 described above, which is performed following the predischarge, ink of other colors adhering to the discharge ports 1001 of the other recording heads 11 are wiped off in the form of liquid droplets.

Figure 10:
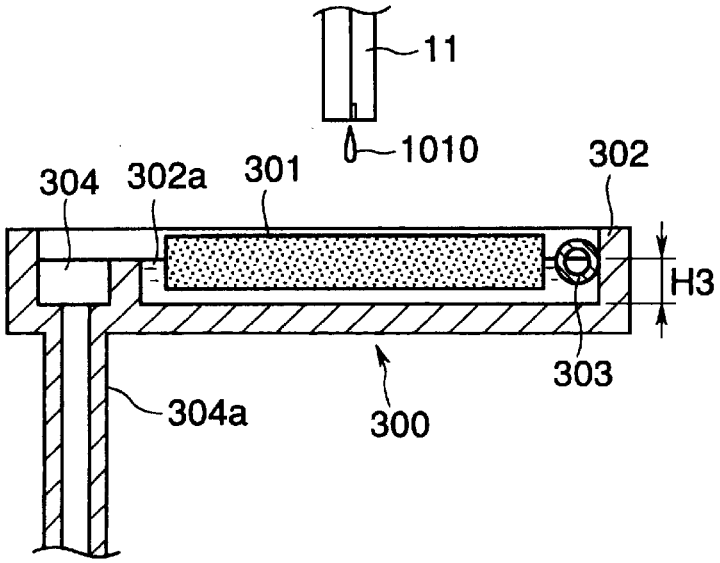
FIG. 10 is a cross-sectional view which shows the predischarge unit of the image formation apparatus represented in FIG. 1.

FIG. 10 is a cross-sectional view which shows the structure of the predischarge unit 300. As shown in FIG. 10, the predischarge unit 300 comprises an absorbent 301 formed by the same porous material as the absorbent 103 for the cap unit 100 to receive and retain ink droplets discharged from the recording head 11; a holder 302 holding the absorbent 301; and a rinsing nozzle 303 arranged in the holder 302 to discharge rinsing liquid, which serves as rinsing liquid supply means for supplying rinsing liquid to a retaining section 302*a*.

The holder 302 forms the retaining section 302*a* to hold and retain rinsing liquid in it, maintaining its liquid level at a specific height H3. Any excessive amount of rinsing liquid is exhausted through a drain 304 to the exhaust unit 600 (see FIG. 1) by way of an exhaust pipe 304*a* serving as means for exhausting liquid retained in the retaining section 302*a*. The absorbent 301 is immersed in rinsing liquid in the retaining section 302*a* to make it easier to absorb the ink droplets 1010 discharged at the time of predischarge. In other words, the liquid held by the absorbent 301 traps the ink droplets 1010 discharged from the recording head 11 and eliminates any rebounding thereof to the recording head 11, thus preventing them from adhering to the recording head 11 as ink mist. The rinsing nozzle 303 is connected to the tank unit 400 (see FIG. 1) to discharge rinsing liquid supplied from the tank unit 400 to the interior of the retaining section 302*a*. Also, the rinsing nozzle 301 is positioned in a location opposite to the drain 304 with the absorbent 301 being placed between them. In this way, the flow of rinsing liquid is made one-way by its discharge from the rinsing nozzle: the contaminated rinsing liquid in the retaining section 202*a* is caused to flow out forcibly. Therefore, the absorbent 301 is rinsed out, and the concentration of dyes in ink retained in the absorbent 301 is lowered to prevent the ink dyes from being extracted into the absorbent 301. Thus ink absorbing capability of the absorbent 301 is maintained.

The predischarge performs the discharges of ink droplets 1010 in the same way as at the time of recording. Therefore, the absorbent 301 is allowed to absorb ink whose amount is only approximately $1/10{,}000$ of the amount of ink to be received by the cap 101 when a pressurized ink feed is executed for the cap unit 100. Usually, therefore, the absorbent 301 is not rinsed during the recording operation. This type of rinsing is executed after the recording is completed.

(4) Tank unit 400

The tank unit 400 is to supply rinsing liquid to the cap unit 100, blade unit 200, and predischarge unit 300. As shown in FIG. 2, the tank 401 for retaining rinsing liquid is positioned above the printer unit 1. Consequently, the tank 401 is positioned in a location higher than the cap unit 100, blade unit 200, and predischarge unit 300. For the pipe connecting the tank 401 and each of the units described above, an electromagnetic valve 402 is provided. By opening this electromagnetic valve 402 appropriately, rinsing liquid stored in the tank 401 is supplied to each of the units by an appropriate amount by means of free falls. Also, rinsing liquid to be stored in the tank 401 is produced by a rinsing liquid processing equipment (not shown) serving as an external device, and then, supplied to the tank 401 for storage.

(5) Pump unit 500

The pump unit 500 is to suck ink or rinsing liquid excessively absorbed by the absorbent 103 (see FIG. 5) of the cap unit 100 and the blade 201 (see FIG. 9) of the blade unit 200, and positioned lower than the cap unit 100 and blade unit 200. As shown in FIG. 2, the pump unit 500 comprises a pump 501, and a suction pipe 502 and an exhaust pipe 503, each connected to the pump 501, respectively. In FIG. 2, only one set of the pump 501, suction pipe 502, and exhaust pipe 503 is represented, but, actually, two sets are arranged: one is used for the cap unit 100 and another, for the blade unit 200 (see FIG. 11). The suction pipe 502 connected to the pump 501 for use of the cap unit 100 is connected to the suction port 107 (see FIG. 5) of the cap unit 100. Also, the suction pipe 502 connected to the pump 501 for use of the blade unit 200 is connected to the blade 201 (see FIG. 9) of the blade unit 200. Each pump 501 is arranged below the cap unit 100 and blade unit 200, respectively. Therefore, by the provision of this difference in height, it becomes easier to suck ink or rinsing liquid from each of the units. Then, ink or rinsing liquid sucked by each pump 501 is exhausted to the exhaust unit 600 through each pipe 503, respectively.

As the kind of the pump 501, there is suitably adoptable a pump that can be driven by the application of pulses or a quantitative pump of positive displacement type whose revolution is constant per time using diaphragm or bellows for the stabilization of the moistened conditions of the absorbent 103 and the blade 201.

(6) Exhaust unit 600

The exhaust unit 600 is to exhaust outside an image formation apparatus ink or rinsing liquid being exhausted from the conducting port 108 (see FIG. 5) of the cap unit 100, exhaust pipe 304*a* (see FIG. 10) of the predischarge unit 300, and each of the exhaust pipes 503 of the pump unit 500, and formed by a liquid receptacle 601 and horse 602 as shown in FIG. 2.

The liquid receptacle 601 is a drainpipe member arranged with an inclination to receive ink or rinsing liquid being exhausted from the conducting port 108 and each of the exhaust pipes 204*a*, 304*a*, and 503. The horse 602 is connected to the lower end of the liquid receptacle 601. Ink or rinsing liquid received by the liquid receptacle 601 flows out to a side groove 603 through the horse 602.

Figure 11:
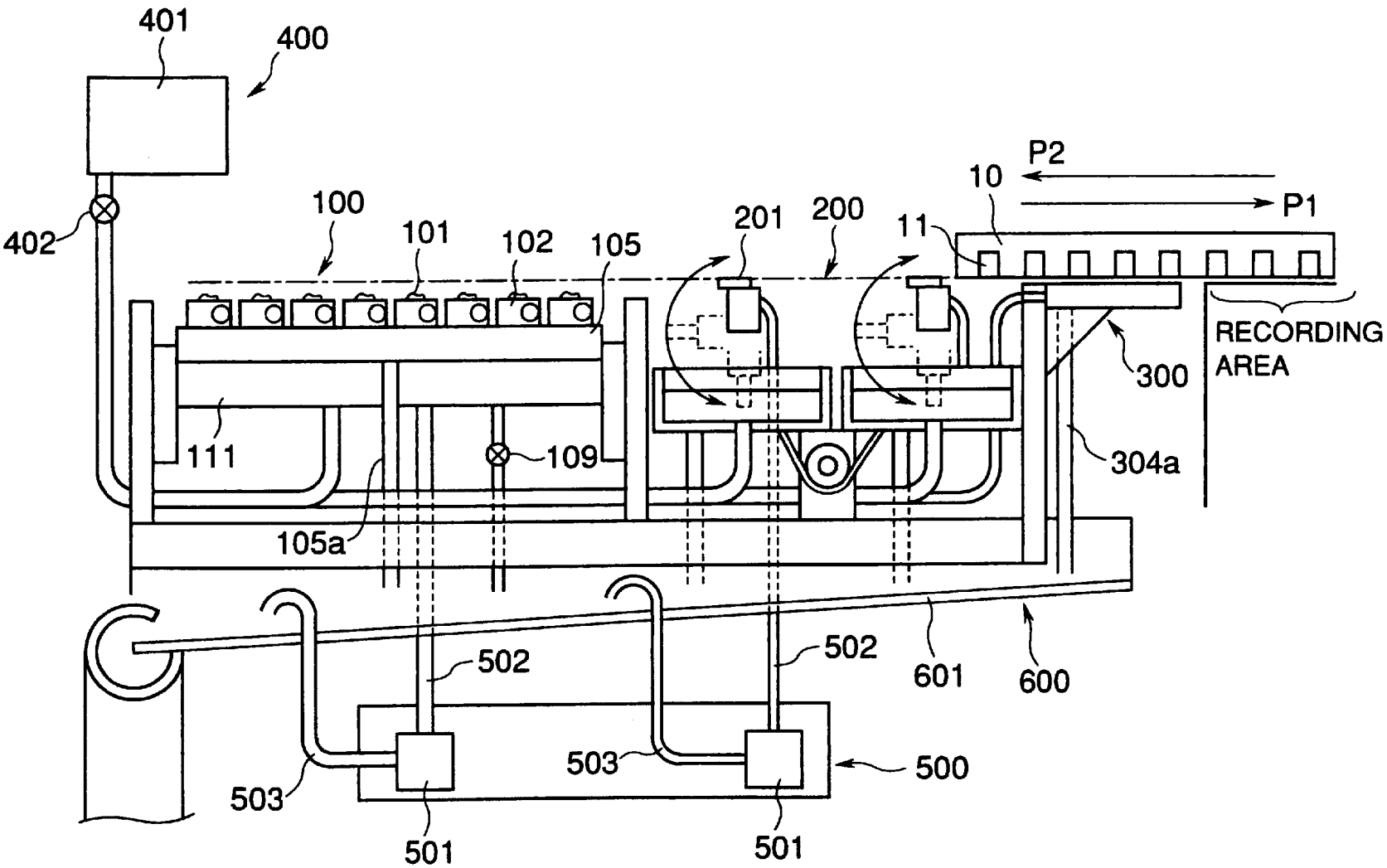
FIG. 11 is a view which schematically shows a recovery device to illustrate the recovery operation of the image formation apparatus represented in FIG. 1.
Figure 12:
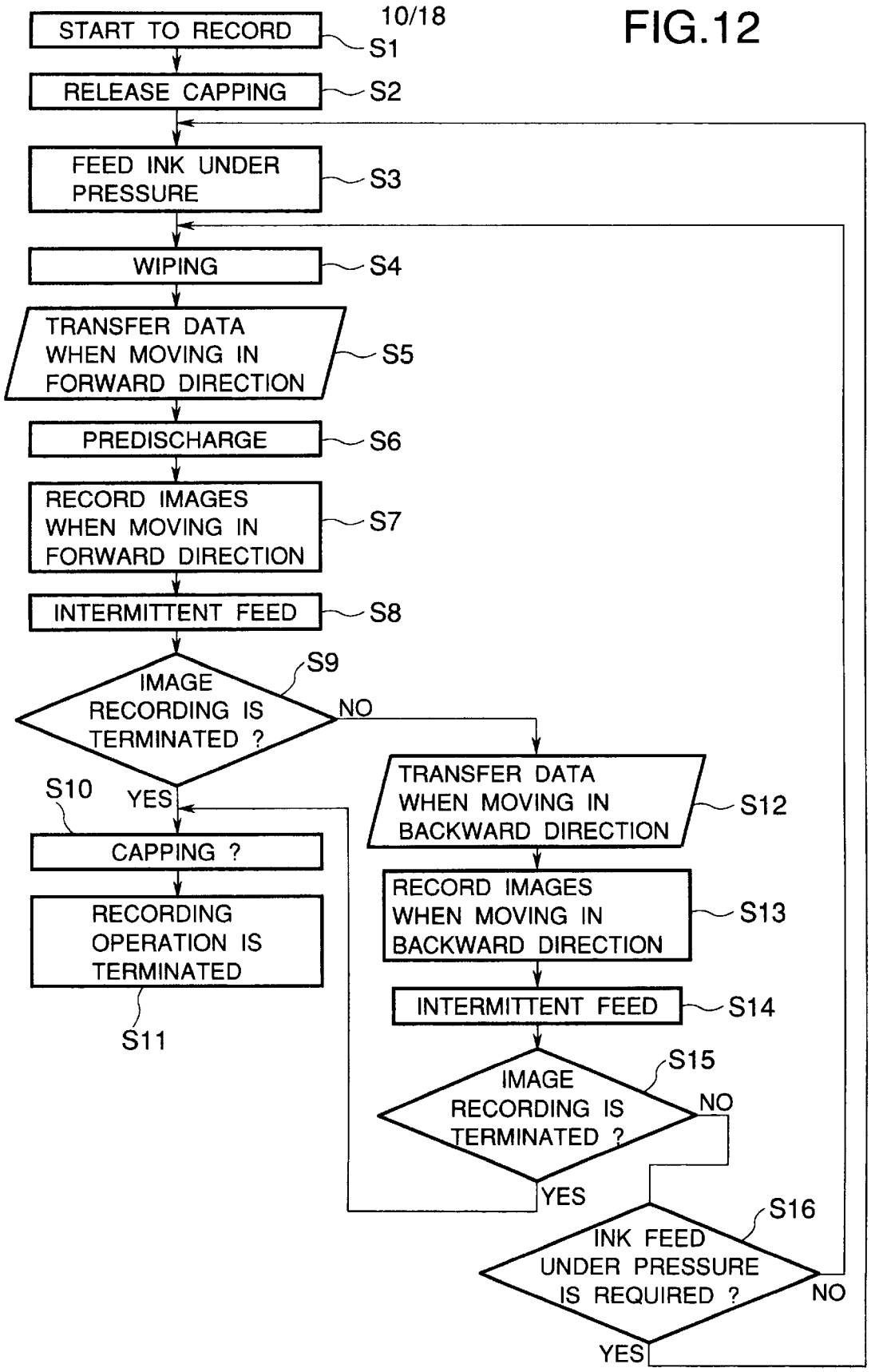
FIG. 12 is a flowchart which shows the recording operation and recovery operation of the image formation apparatus represented in FIG. 1.

Now, with reference to FIG. 1, FIG. 11, and FIG. 12, the description will be made of the operation of the image formation apparatus and the related operations of each units of the recovery device 20 described above. FIG. 11 is a view which shows the structure of the recovery device 20 to illustrate the recovery operation of the image formation apparatus represented in FIG. 1. FIG. 12 is a flowchart which shows the recording operation and recovery operation of the image formation apparatus represented in FIG. 1.

At first, before recording, a recording medium A is drawn around to the winding unit 4 from the let out unit 3 through the feed unit 2 for setting. When the setting of the recording medium A is completed, recording is started (step S1). In this respect, prior to starting the recording operation, the carriage 10 is at the home position, and each of the recording heads 11 is capped by means of the cap unit 100.

When the recording is started, the supporting board 111 of the cap unit 100 moves downward to release capping (step S2). The pressurized ink feed is conducted from the ink supply device 13 (step S3). In this way, ink is forced out from the recording heads 11. Ink thus forced out is absorbed by the absorbent 103 (see FIG. 5) installed in the cap 101 of the cap unit 100.

When the pressurized ink feed is completed, the carriage 10 moves in the direction indicated by an arrow P1 for wiping by use of the blade 201 of the blade unit 200 (step S4). At this juncture, the electromagnetic valve 402 of the tank unit 400 is opened to supply rinsing liquid from the tank 401 to the interior of the cap 101 of the cap unit 100. Thus the cap 101 of the cap unit 100 and each of the absorbents 103 and 110 are rinsed out. The rinsing liquid flows in the receptacle 104 (see FIG. 5) of the holder 102 together with ink forced out from the recording heads 11 by means of the pressurized ink feed, and, further, overflows from the receptacle 104, thus being collected by means of the liquid collector 105 to drop off to the liquid receptacle 601 of the exhaust unit 600 through the exhaust pipe 105*a*. Also, the rinsing liquid excessively absorbed by the absorbent 103 is sucked by means of the pump 501 of the pump unit 500 for use of the cap unit 100 through the suction pipe 502, hence dropping off to the liquid receptacle 601 through the exhaust pipe 503.

Also, after the completion of wiping, the blade 201 of the blade unit 200 is rinsed out, and then, the rinsing liquid excessively absorbed by the blade 201 because of this rinsing of the blade 201 is sucked by use of the pump 501. This operation is completely executed by the time the next wiping is required.

Then, from the source of data transfer, such as a computer or leader, image data for one scanning portion (forward scan in the direction indicated by the arrow P1) are transferred to a recording controller (not shown) (step S5). When the data are transferred, the carriage 10 moves further in the direction indicated by the arrow P1, the image is recorded for one scanning portion (step S7) after predischarge is effectuated above the predischarge unit 300 (step S6), and then, the recording medium A is intermittently fed by means of the feed unit 2 just by a recording length L (Step S8).

Here, whether or not the image recording should be terminated is determined (step S9). If affirmative, the carriage 10 is caused to move to the home position, and then, by means of the cap unit 100, capping operation is carried out by the cap unit 100 with respect to the recording heads 11 (step S10), hence terminating the recording operation (step S11).

When capping the recording head 11, a gap is formed between the recording head 11 and cap 101. Here, the electromagnetic valve 109 of the pipe connected to the conducting port 108 (see FIG. 5) of the cap unit 100 is opened in order to prevent the pressure in such gap from rising due to the close contact between the recording head and the cap. When the electromagnetic valve is opened, the air and liquid, which have flown into the conducting port 108, are allowed to drop off to the liquid receptacle 601 of the exhaust unit 600. With the termination of capping operation, the electromagnetic valve 109 is closed. Also, at the same time that the recording operation is terminated, rinsing liquid is supplied from the tank 401 to the predischarge unit 300, thus rising off the absorbent 301 (see FIG. 10) of the predischarge unit 300. The liquid overflowing from the predischarge unit 300 after the supply of rinsing liquid to the predischarge unit 300 is caused to drop off to the liquid receptacle 601 of the exhaust unit 600 through the exhaust pipe 304*a*.

Meanwhile, if the image recording is to continue, the image data are transferred for the backward movement of the recording heads in the direction indicated by an arrow P2 (step S12), and then, the carriage 10 travels in the direction indicated by the arrow P2 for the execution of image recording at the time of backward movement (step S13). When the image recording is completed for the backward movement, the recording medium A is intermittently fed as in the step S8 (step S14).

Then, whether or not the image recording should be terminated is again determined (step S15). If affirmative, the carriage 10 is caused to move to the home position, and then, by means of the cap unit 100, capping is performed with respect to the recording head 11 (step S10) to terminate the recording operation (step S11). If the image recording should be continued, it is determined whether or not the pressurized ink feed is needed depending on the number of scans that have been carried out (step S16). If affirmative, the carriage 10 is caused to move above the cap unit 100 for the execution of pressurized ink feed in the step S3 to which the process will return. Then, operations in the step S4 and on will be repeated. On the other hand, if it is negative, the carriage 10 is caused to move above the blade unit 200 for the execution of wiping, and then, the operations in the step S5 and on will be repeated.

Second Embodiment

Figure 13:
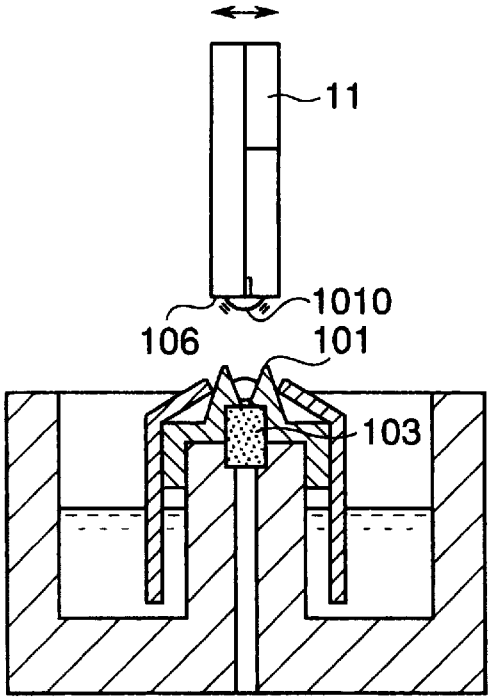
FIG. 13 is a view which illustrates the operation subsequent to the pressurized supply of ink to the cap for the image formation apparatus in accordance with a second embodiment of the present invention.

Here, with reference to FIG. 13, the description will be made of an example in which the operation of a carriage after the execution of the pressurized ink feed differs from the operation described in the first embodiment. The structure of the image formation apparatus itself is the same as the one described in the first embodiment. Therefore, the description of the structure will be omitted, while the same reference marks as those appearing in the first embodiment are applied to the same constituents described in FIG. 13.

After the pressurized ink feed, ink droplets 1010 are formed on the discharge port surface 1006 of the recording head 11. The ink droplets do not drop off even after having developed themselves on the surface, thus a considerable amount of ink droplets 1010 still left adhering to the surface in some cases. This phenomenon depends mainly on the physical properties of ink (surface tension) and the physical properties of the interface (contact angle) between ink and the discharge port surface 1006. If capping is conducted in such state, the absorbent 103 cannot absorb ink completely, and then, the ink yet to be absorbed is pressed to flow from the discharge ports reversely to the interior of the recording head 11.

In order to prevent this, the recording head 11 is caused to vibrate finely by reciprocating the carriage 10 minutely after the pressurized ink feed. In this way, the ink droplets 1010 adhering to the discharge port surface 1006 can joggle to drop down themselves. At the same time, the pump unit 500 is driven to enable the absorbent 103 to absorb ink thus dropped off from the discharge port surface 1006, and then, the ink thus absorbed in the absorbent 103 is sucked by means of the pump 500 to exhaust it to the outside. Subsequently, capping is performed as in the case of the first embodiment. By the operation described above, it is possible to remove the large ink droplets 1010 formed on the discharge port surface 1006. In this respect, the cap 101 is rinsed as in the first embodiment.

Third Embodiment

Figure 14:
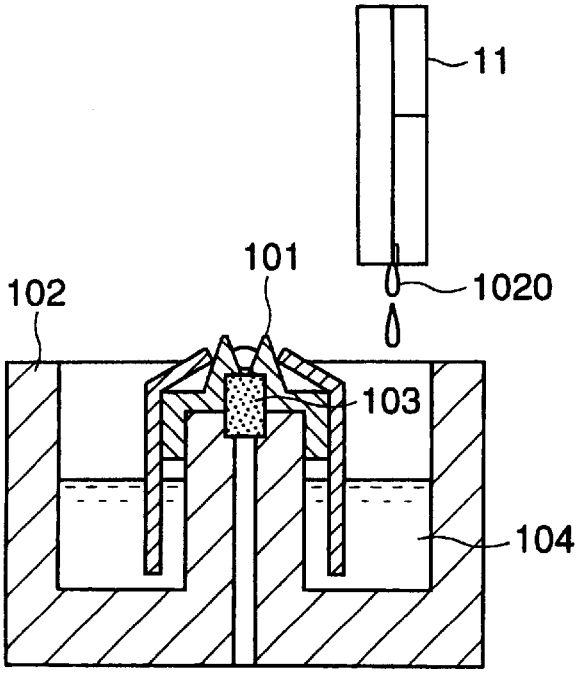
FIG. 14 is a view which illustrates the operation of pressurized ink feed to the cap unit for the image formation apparatus in accordance with a third embodiment of the present invention.

Here, with reference to FIG. 14, the description will be made of an example in which the pressurized ink feed is performed for initializing a recording head for operation. For the present embodiment, the structure of an image formation apparatus itself is also the same as the structure described in the first embodiment. Therefore, the description of the structure will be omitted, while the same reference marks as those appearing in the first embodiment are applied to the same constituents described in FIG. 14.

Usually, a new recording head 11 is filled with a specific liquid 1020 in advance in order to prevent the interior of the discharge ports from being dried and affected by any mixture of dust particles, and also, provide aging for ink in it. As this liquid 1020, a clear ink or ink of the color used for most frequently is adopted taking the reduction of costs into account. If ink is completely exhausted while recording is in operation, the current recording head should be replaced with a new recording head 11. In this case, therefore, it is necessary to suspend the operation of the apparatus, and then, install the new recording head 11 after its filled-in liquid 1020 is let out and ink to be used for recording filled in to make the head ready for use.

Here, in accordance with the present embodiment, the new recording head 11 is installed on the carriage 10 with the filled-in liquid 1020 still left intact. Then, after the recording head 11 is positioned above the receptacle 104 of the holder 102, the pressurized ink feed is performed in this position to cause the filled-in liquid 1020 to be forcibly exhausted from the recording head 11 by means of this feed of ink to be used. The reason why the pressurized ink feed is performed on the receptacle 104 outside the cap 101 is that if this particular feeding is conducted on the absorbent 103, the liquid 1020 forcibly exhausted from the recording head 11 adheres to the absorbent 103 reliably. Since the receptacle 104 is arranged for the holder 102 in such a way, the pressurized ink feed should be executed on this receptacle 104 so as to make it easier to let out the filled-in liquid 1020 from the recording head 11. Consequently, the time required for suspending the operation of the apparatus is made shorter at the time of replacing recording heads 11 for the effective execution of recording.

Fourth Embodiment

Figure 15:
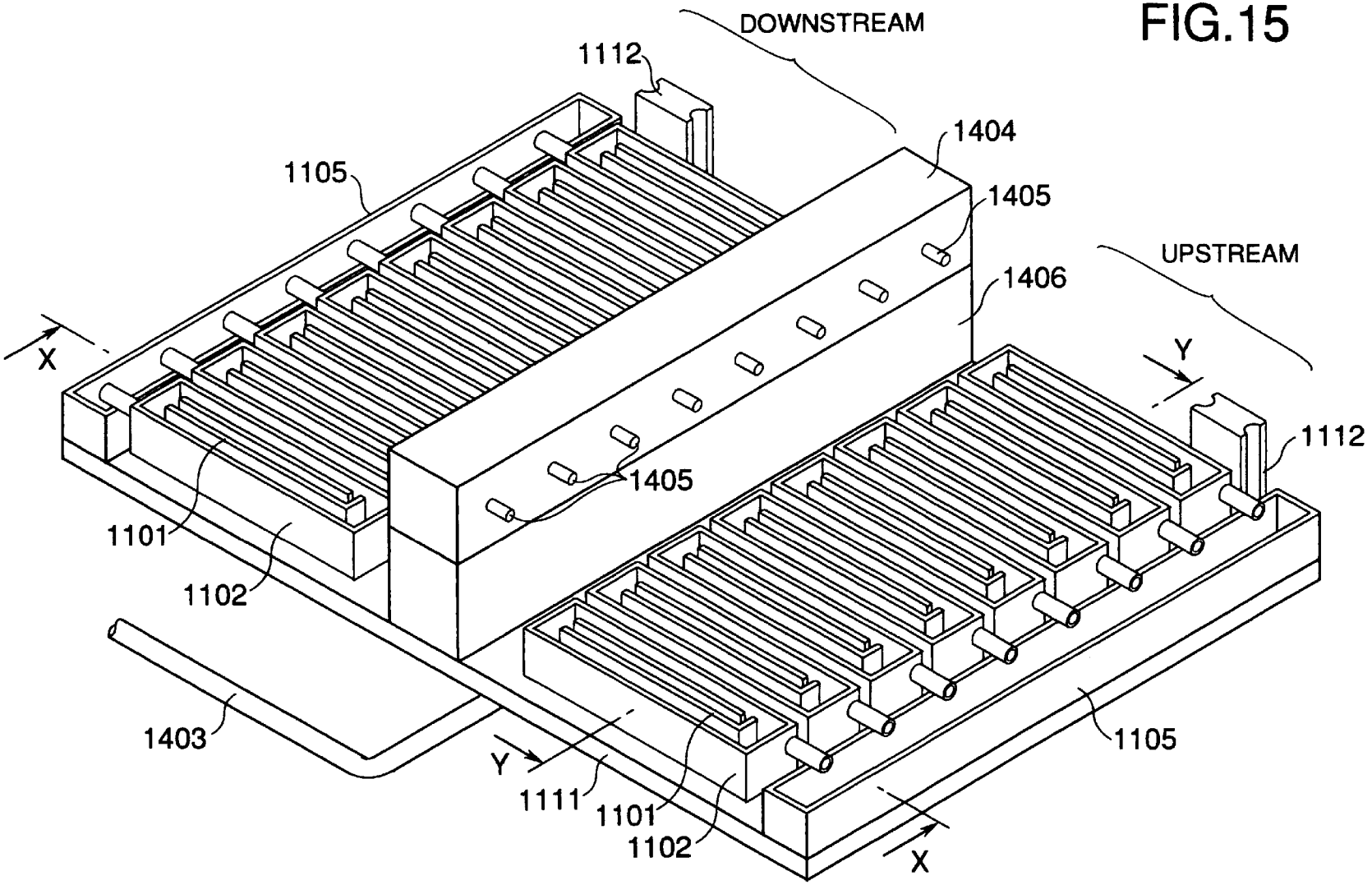
FIG. 15 is an enlarged perspective view which shows the cap unit of a printing apparatus in accordance with a fourth embodiment of the present invention.

FIG. 15 is an enlarged perspective view which shows the cap unit of a printing apparatus in accordance with the present embodiment. The cap unit 100 is arranged to face the recording head 11 at the home position of the carriage 10. As shown in FIG. 15, the cap unit is provided with a supporting board 111 having sixteen holders 102 fixed on it, each arranged corresponding to the position of each recording head 11. Also, in each of the holders 1102, the cap 1101 is installed for capping each recording head 11 as capping means. The supporting board 1111 is provided with guide rails 1112 to make it movable in the up and down directions. With the up and down movement thereof, capping and the release of capping are performed, respectively.

Each cap 1101 is formed by an elastic material, such as fluoro, silicone, or chlorinated butyl rubber, to enhance the close contact and airtightness with each recording head 11 when capping is conducted.

A reference numeral 1404 designates a manifold that distributes rinsing liquid. Its interior is hollow. It is connected to the tank unit 400 by means of one pipe 1403. The manifold 1404 is positioned between the eight caps on the up stream side and the eight caps on the down stream side to enable the rinsing liquid to be distributed among sixteen caps in total. A reference numeral 1405 designates each of the rinsing nozzles that discharge the rinsing liquid distributed by the manifold onto each of the caps 1101, and positioned corresponding to each of the caps. A reference numeral 1406 designates a supporting base fixed to a supporting board 1111 for supporting the manifold 1405.

Figure 16:
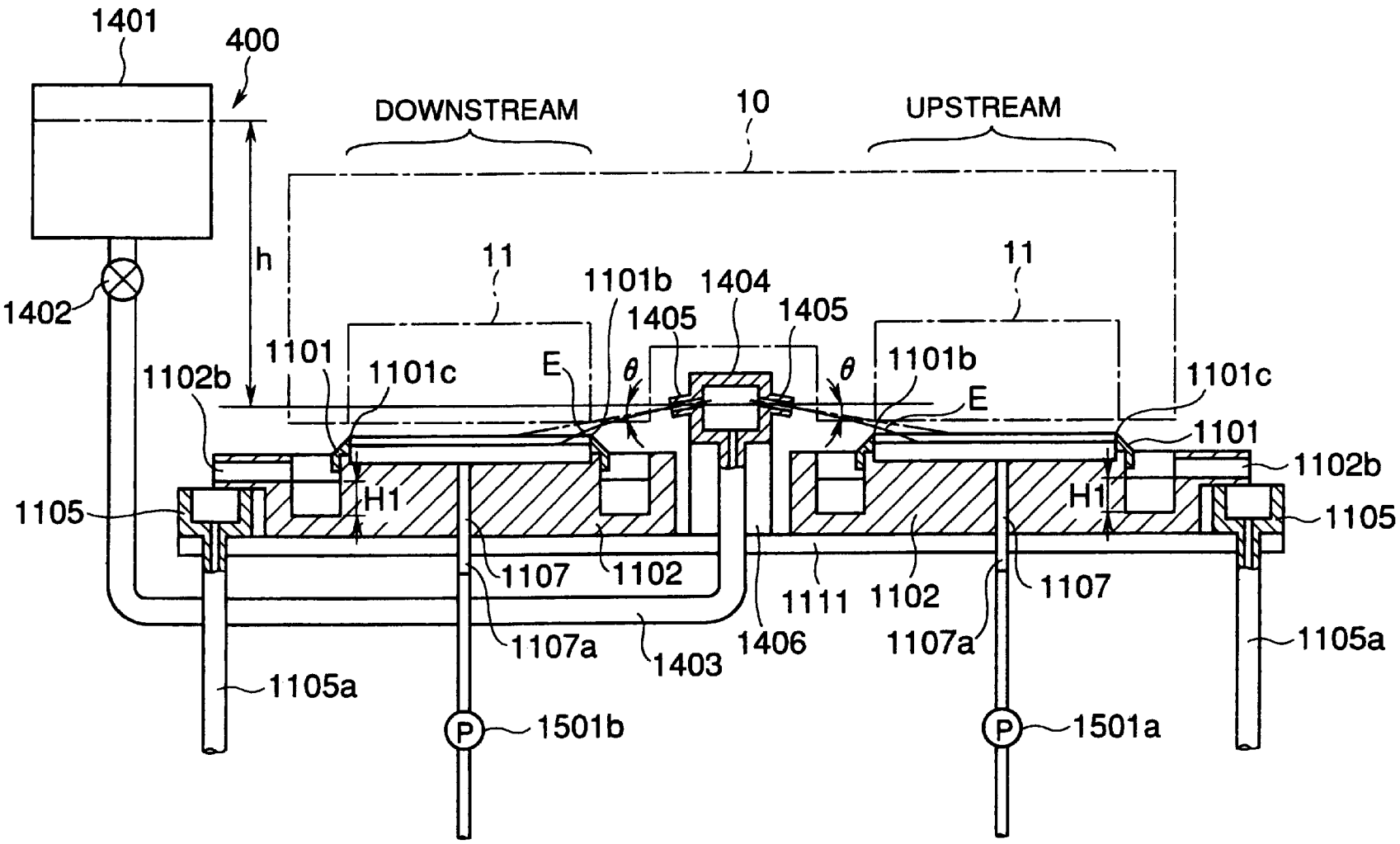
FIG. 16 is a cross-sectional view which shows the vicinity of the holder of the cap unit represented in FIG. 15, taken in the direction X.

FIG. 16 is a cross-sectional view which shows the vicinity of the holder of the cap unit 20 represented in FIG. 15, taken in the direction X (longitudinal direction of the holder 1102). As a cross-sectional view of the vicinity of the holder of the cap unit 20, taken in the direction Y (shorter side direction of the holder 1102), FIG. 6 is usable.

As shown in FIG. 16 and FIG. 6, the cap 1101 is fixed to a cap mounting section 1102*a* of the holder 1102. In the cap 1101, an absorbent 1103 formed by foam urethane, sintered compact, textile net, or other porous material is installed to form a gap D between the absorbent and the recording head 11 at the time of capping. The absorbent 1103 holds liquid thereby to maintain the interior of the cap 1101 at high humidity, hence suppressing the evaporation of water content of ink in the recording head 11 to minimize the causes for ink to become overly viscous. Liquid held by the absorbent 1103 is ink forced out from the discharge port 1001, and rinsing liquid used for rinsing the interior of the cap 1101. Also, the ink absorbent 1103 sucks from the discharge port surface 1006 the ink droplets adhering to the discharge port surface 1006 due to the ink that has been forced out from the discharge ports 1001 by the pressurized ink feed. In this way, the ink droplets are carried into the cap 1101 rapidly.

On the circumference of the cap mounting section 1102*a* of the holder 1102, the receptacle 1104 is formed in the position lower than the cap 1101. The receptacle 1104 retains ink, rinsing liquid, or the mixed liquid thereof, while maintaining a specific liquid level H1. Any liquid exceeding the liquid level H1 is exhausted to a liquid collector 1105 through a drain 1102*b* arranged at the end portion of the holder 1102. The liquid collector 1105 collects liquid from each of the holders 1102 to let it out to the exhaust unit 600 (see FIG. 1) through the exhaust pipe 1105*a* serving as exhausting means for exhausting liquid in the receptacle 1104.

On the surface of cap mounting section 1102*a* of the holder 1102, where the absorbent 1103 is installed, a suction port 1107 is opened.

The suction port 107 is to let out liquid from the interior of the cap 1101. It is connected to the pump 1501 (see FIG. 17) by means of a joint 1107*a* so as to suck the liquid in the cap 1101. In other words, suction means is constituted by this suction port 1107 and the pump 1501 for sucking liquid from capping means to exhaust it. A pump 1501*a* is arranged to suck the eight caps on the up stream side, and a pump 1501*b* sucks the eight caps on the down stream side (see FIG. 16).

The rinsing nozzles 1405 are arranged with its discharge ports being positioned above the caps 1101, and paralleled in the longitudinal direction of the caps 1101. The nozzles are at an angle of depression e to the caps 1101, and the locus of the rinsing liquid forms parabola E. The channel position of the rinsing liquid is set in the vicinity of the end portion 1101*b* closer to the rinsing nozzles 1405 in the longitudinal direction of the caps 1101. The rinsing liquid is caused to flow to the other end portion 1101*c* along the apertures 1101*a* of the caps 1101.

Further, as shown in FIG. 6, a second absorbent 1110 is installed on the external side of the cap 1101. On the end portion (upper end) of this absorbent is positioned near the contacting portion between the cap 1101 and recording head 11, and the other end (lower end) of the absorbent is positioned to be immersed in the liquid retained in the receptacle 1104.

Now, the operation of capping unit 100 will be described.

Figure 17:
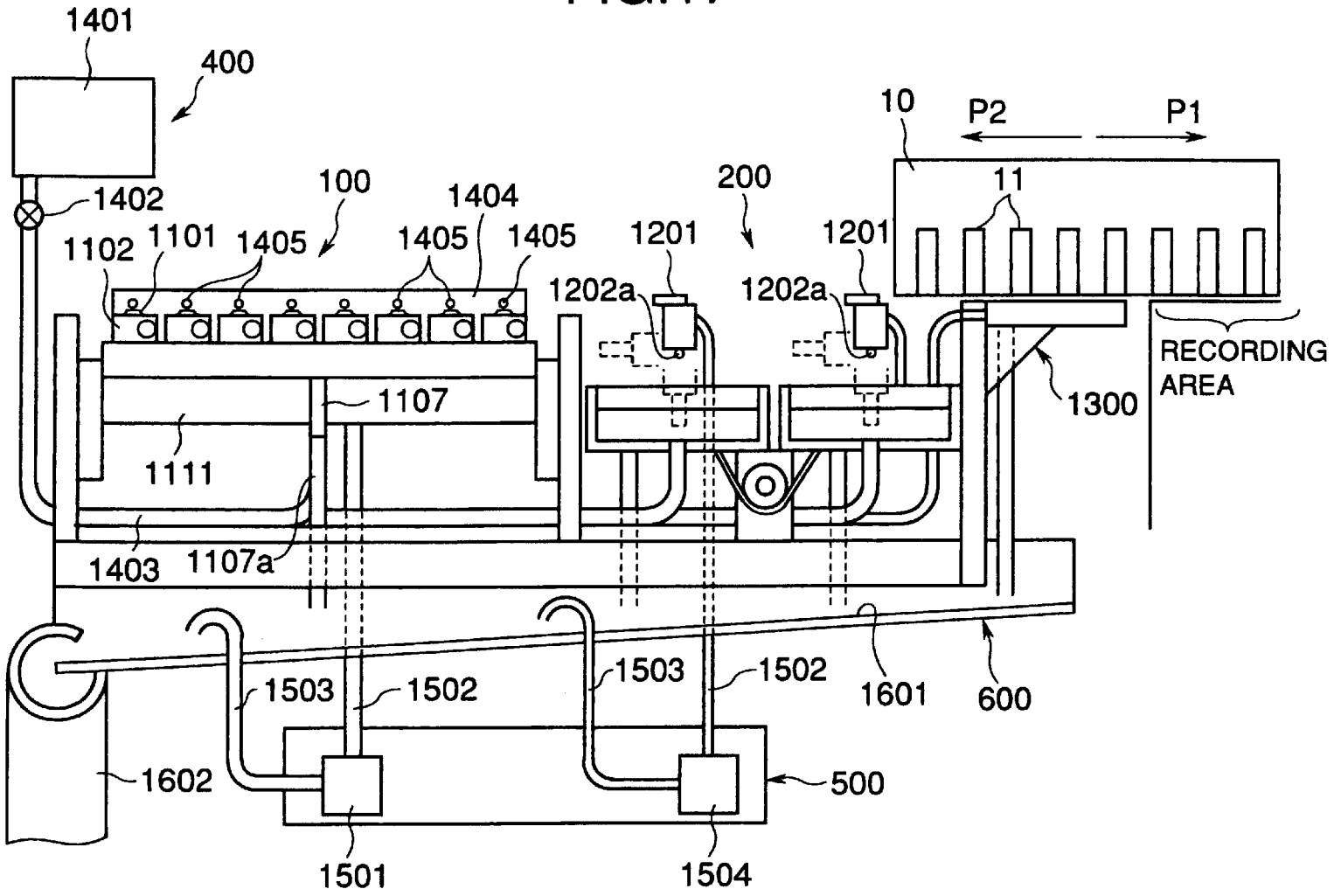
FIG. 17 is a view which schematically shows a recovery device to illustrate the recovery operation of the printing apparatus in accordance with the fourth embodiment of the present invention.

Separately from recording by use of the recording head 11, a pressurized ink feed is performed at the starting time of recording or per given number of reciprocations at the time of recording (usually, 50 to 100 reciprocations each) in order to force out the overly viscous ink in the recording head 11. As shown in FIG. 17, this pressurized ink feed is to exhaust the overly viscous ink and remaining air bubbles in the discharge ports 1001 to the cap 1101 from the discharge ports 1001 by driving the supply pump of the ink supply device (see FIG. 1), while the recording head 11 is positioned to face the cap 1101 in a state that both of them are apart from each other. This operation is effective in rinsing out dust particles or the like, if any, adhering to the surface of discharge ports 1001 or residing in the discharge ports 1001 so as to maintain the stable discharges.

After the completion of the pressurized ink feed, most of the ink droplets 1010 formed on the discharge port surface 1006 drop off by its own weight, which are absorbed by the absorbent 1103. However, a part of such ink droplets still remains adhering to the discharge port surface 1006 together with small ink droplets. Therefore, as shown in FIG. 6, the recording head 11 is once capped with the cap 1101 for a capping operation to absorb ink adhering to the discharge port surface 1006 by use of the absorbent 1103. This operation is needed, particularly when the ink whose surface tension is low, and wettability is high when adhering to the discharge port surface 1006. Depending on the physical properties of ink to be used, the performance of this operation is not necessarily needed from the viewpoint of obtaining a shorter operational time.

Subsequent to the operation described above, the capping by use of the cap 1101 is released, and then, the recording head 11 moves in the direction indicated by an arrow P1 to position it on the blade unit 200 (see FIG. 1). At the same time, the operation is performed with respect to the cap 1101 for rinsing the absorbent 1103 that has absorbed ink forced out by the application of the pressurized ink feed as described above. In other words, the electromagnetic valve 1402 (see FIG. 16) is opened to discharge rinsing liquid from the tank onto the cap 1101 for supply. As the kind of rinsing liquid, it is suitable to use the liquid to be used as ink solvent, pure water, colorless clear ink or the like having the same chemical composition as that of ink to be used but not containing any dyes in it.

The amounts of rinsing liquid supply to the cap 1101 vary depending on the degrees of its stains, but are roughly divided into the following two:

(1) If the recording head 11 is shorter and the number of its discharge ports is smaller, thus the amount of ink to be exhausted being small or if the surface tension of ink to be used is high and its wettability is low on the cap 1101, the amount of rinsing liquid supply is set to be almost the same as the inner volume of the cap 1101, and then, the inner wall face of the cap 1101 is rinsed.

(2) If the recording head 11 is longer, and the number of discharge ports 1001 is larger, thus the amount of ink to be exhausted being large or if the surface tension of ink to be used is low to make the wettability high on the cap 1101, the amount of rinsing liquid supply is set to be more than the inner volume of the cap 1101, and then, the contacting portion of the cap 1101 with the recording head 11, as well as the outer circumference of the cap, is rinsed by allowing the rinsing liquid to overflow from the cap 1101.

In order to perform rinsing efficiently, the parameters are set for the present embodiment as given below so as to maximize the degree of motion (=flowrate×discharge) of the rinsing liquid to be discharged from each rinsing nozzle 1405. In other words, while the difference h in the water head between the tank 1401 and rinsing nozzle 1405, the inner diameter and length of the pipe 1403, and the Cv value (velocity coefficient) of the electromagnetic valve 1402 are restricted to a certain extent due to the space available for arrangement of the recovery device 20 for the printer unit 1, the inner diameter of outlet of each rinsing nozzle 1405 is set to make the aforesaid degree of motion maximum in condition that the difference h in water head is made maximum; the inner diameter of the pipe 1403, maximum and its length, minimum; the Cv value of the electromagnetic valve, minimum, respectively.

Subsequent to having supplied rinsing liquid, liquid in the cap 1101 and liquid retained in the absorbent 1103 are sucked from the suction port 1107 by means of the pump unit 500 (see FIG. 1), and exhausted to the exhaust unit 600 ultimately. With the operation of this suction, the state of the absorbent 1103 is kept appropriately moistened.

Liquid sucked by this suction is a mixture of the rinsing liquid supplied from the liquid supply port 1106 and ink discharged from the recording head 11. As a result, ink is exhausted together with the rinsing liquid when sucking this liquid mixture. In other words, the concentration of dyes in ink adhering to the cap 1101 and also, in ink sucked by the absorbent 1103 is made lower. As a result, the inner wall of each cap 1101 and the absorbent 11103 are rinsed. Moreover, when a large amount of rinsing liquid is supplied as in the description (2) above, ink is caused to flow out of the cap 1101 together with the rinsing liquid thus applied. As a result, the external wall of each cap 1101 is also rinsed. In this way, the extraction of dyes in ink to each cap 1101 and absorbent 1103 is suppressed by rinsing each cap 1101 and absorbent 1103. Also, even if the extracted substance is deposited, it is possible to dissolve such substance in the rinsing liquid or washed it away by supplying the rinsing liquid.

Therefore, it is possible to suppress the deterioration of the recovery function due to the deposition of the extracted substance on each cap 1101 and absorbent 1103, and also, prevent the extracted substance from adhering to each recording head 11 by the execution of capping, hence maintaining the stable discharges of ink from each of the recording heads 11.

Meanwhile, the absorbent 1110 installed outside each cap 1101 absorbs ink if the ink droplet 1010 does not drop into the cap 1101 but onto the outside thereof when it is caused to drop off as shown in FIG. 17. Further, the lower end portion of the absorbent 1110 is immersed in the liquid in the receptacle 1104 as described earlier. Thus, with the difference G in water head created in the absorbent 1110, ink is guided into the receptacle 1104. In this way, it is possible to prevent dyes in ink from being extracted outside each cap 1101, particularly in the vicinity of the contacting portion between the cap and recording head 11. Also, the absorbent 1110 is able to guide rinsing liquid to the receptacle 1104 together with ink by means of this difference G in water head even when the rinsing liquid is supplied until it is overflown. In this way, the absorbent 1110 is rinsed out.

As described above, with the provision of rinsing nozzles outside the caps, there is no possibility that rinsing liquid is contaminated by ink when executing the pressurized ink feed. Also, there is no possibility that ink of other colors are allowed to flow around into any of the caps that are dedicated to use of ink of other kinds, respectively.

(2) Blade unit 200

In recording, ink mist is generated. It adheres to the discharge port surface 1006. If this adhering mist approaches the discharge ports 1001, the discharges are made unstable. Also, the ink droplets on the discharge port surface 1006 cannot be absorbed completely, even if the absorption is intended by use of the absorbent 1103 of the cap unit 100 subsequent to the pressurized ink feed. The remaining ink droplets, too, may cause unstable discharges. The blade unit 200 is to wipe off the discharge port surface 1006 for cleaning in order to prevent unstable discharges from being caused by the adhesion of ink mist or the like to the discharge port surface 1006. This unit is positioned more on the recording area side than the cap unit 100.

Wiping is executed by rotating the holder 1202 in a state that the recording head 11 is positioned above the pivot 1202*a*.

The wiping operation is executed without fail subsequent to each pressurized ink feed described earlier. Also, per reciprocation of the recording head 11 or per a predetermined number of reciprocations thereof, the wiping operation is performed. In accordance with the present embodiment, it is arranged that four recording heads 11 are allocated to one blade 1201 for wiping. Also, the blade 1201 is connected to the pump unit 500 (see FIG. 1), and an appropriately moisten state of the blade 1201 is maintained by sucking by means of the pump unit 500 any rinsing liquid that has been excessively absorbed when the blade is immersed in the rinsing liquid retained in the rinsing tank 1203. Therefore, wiping is perfectly executed for each of the recording heads 11.

(3) Predischarge unit 300

When the duty is low for an image to be recorded, there are some discharge ports 1001 rarely required to discharge, leading to the creation of overly viscous ink due to the evaporation of its water content in some cases. In order to prevent this, specific driving pulses are applied by the predischarge unit 300 to such recording head 11 before start of recording so as to cause ink to be discharged from all the discharge ports 1001 (this operation being called "predischarge"). Also, with wiping by means of the blade unit 200 described above, which is performed following the predischarge, ink of other colors adhering to the discharge ports 1001 of the other recording heads 11 are wiped off as liquid droplets.

(4) Tank unit 400

The tank unit 400 is to supply rinsing liquid to the cap unit 100, blade unit 200, and predischarge unit 300. As shown in FIG. 17, the tank 1401 for retaining rinsing liquid is positioned above the printer unit 1. Consequently, the tank 1401 is positioned in a location higher than the rinsing nozzles 1405. For the pipe from the tank unit 400 to the cap unit 100 and wiping unit 200, though not shown in FIG. 17, is such that one main pipe from the tank unit 400 is branched into two pipes on the way, and each of the branches pipes is provided with an electromagnetic valve, respectively. Therefore, any reverse flow to the main pipe is prevented. Also, such branching point is positioned higher than the cap unit 100 and the wiping unit 200. For example, an electromagnetic valve 1402 is installed on the way of piping 1403 that connects the tank 1401 and the manifold 1404. By opening this electromagnetic valve 1402, rinsing liquid to be stored in the tank 1401, which is produced by a rinsing liquid processing equipment (not sown) serving as an external device, is supplied to the tank 1401 for storage.

(5) Pump unit 500

The pump unit 500 is to suck ink or rinsing liquid excessively absorbed by the absorbent 1103 (see FIG. 16) of the cap unit 100 and the blade 1201 of the blade unit 200, and positioned lower than the cap unit 100 and blade unit 200. As shown in FIG. 6, the pump unit 500 comprises pumps 1501 and 1504, and a suction pipe 1502 and an exhaust pipe 1503, each connected to the pumps 1501 and 1504, respectively. The pump 1501 is connected to those for use of the cap unit 100, and the pump 1504 is connected to those for use of the blade unit 200 (see FIG. 17). Each of the pumps 1501 and 1504 is arranged below the cap unit 100 and blade unit 200. Therefore, by the provision of this difference in height, it becomes easier to suck ink or rinsing liquid from each of the units. Then, ink or rinsing liquid sucked by each of the pumps is exhausted to the exhaust unit 600 through each pipe 1503, respectively.

As the kind of the pumps 1501 and 1504, there is suitably adoptable a pump that can be driven by the application of pulses or a quantitative pump of positive displacement type whose revolution is constant per time using diaphragm or bellows.

(6) Exhaust unit 600

The exhaust unit 600 is to exhaust outside the printing apparatus ink or rinsing liquid being exhausted from each of the exhaust pipes 1503 of the pump unit 500 and formed by a liquid receptacle 1601 and horse 1602 as shown in FIG. 17.

Figure 18:
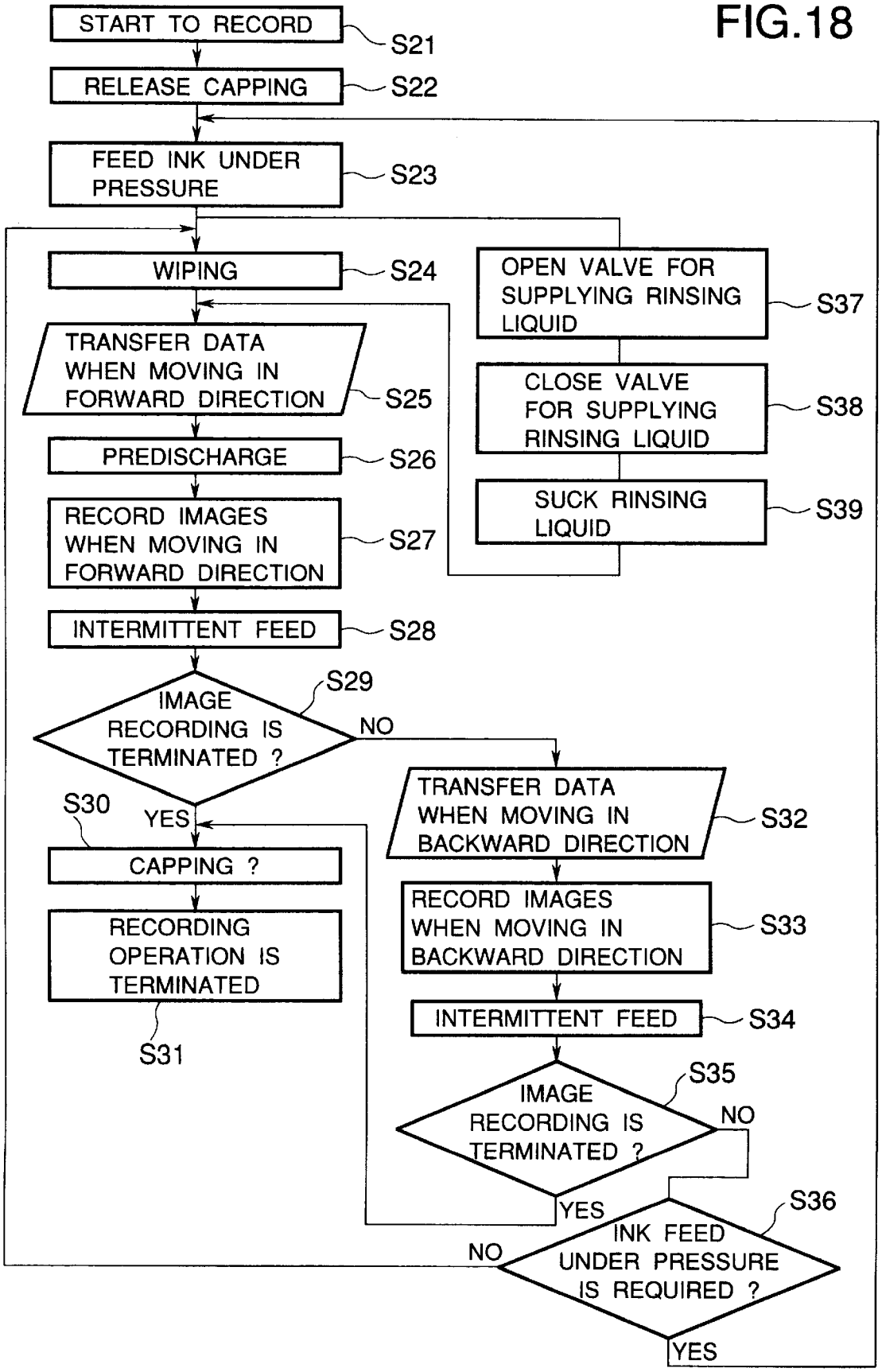
FIG. 18 is a flowchart which shows the recording operation and recovery operation of the printing apparatus in accordance with the fourth embodiment of the present invention.

Now, with reference to FIG. 1, FIG. 17, and FIG. 18, the description will be made of the recording operation of the printing apparatus and the related operations of each units of the recovery device 20 described above. FIG. 17 is a view which shows the structure of the recovery device 20 to illustrate the recovery operation of the printing apparatus shown in FIG. 1. FIG. 18 is a flowchart which shows the recording operation and recovery operation of the printing apparatus represented in FIG. 1.

At first, before recording, a recording medium A is drawn around to the winding unit 4 from the let out unit 3 through the feed unit 2 for setting. When the setting of the recording medium A is completed, recording is started (step S21). In this respect, prior to starting the recording operation, the carriage 10 is at the home position, and each of the recording heads 11 is capped by means of the cap unit 100 for capping.

When the recording is started, the supporting board 1111 of the cap unit 100 moves downward to release capping (step S22). The pressurized ink feed is conducted from the ink supply device 13 (step S23). In this way, ink is forced out from the recording heads 11. Ink thus forced out is absorbed by the absorbent 1103 (see FIG. 16) installed in the cap 1101 of the cap unit 100.

When the pressurized ink feed is completed, the carriage 10 moves in the direction indicated by an arrow P1 for wiping by use of the blade 1201 of the blade unit 200 (step S24). At the same time, the electromagnetic valve 1402 of the tank unit 400 is opened (step S37) to discharge rinsing liquid from the tank 1401 to the cap 1101 of the cap unit 100. After a given time elapses, the electromagnetic valve 1402 is closed (step S38). Thus the cap 1101 of the cap unit 100 and each of the absorbents 1103 and 1110 are rinsed out. The rinsing liquid flows in the receptacle 1104 (see FIG. 16) of the holder 1102 together with ink forced out from the recording heads 11 by means of the pressurized ink feed, and, further, overflows from the receptacle 1104, thus being collected by means of the liquid collector 1105 to drop off to the liquid receptacle 1601 of the exhaust unit 600 through the exhaust pipe 1105*a*. Also, the rinsing liquid excessively absorbed by the absorbent 1103 is sucked by means of the pump 1501 of the pump unit 500 for use of the cap unit 100 through the suction pipe 1502 (step S39), hence dropping off to the liquid receptacle 1601 through the exhaust pipe 1503.

Also, after the completion of wiping, the blade 1201 of the blade unit 200 is rinsed out, and then, the rinsing liquid excessively absorbed by the blade 1201 because of this rinsing of the blade 1201 is sucked by use of the pump 1501. This operation is completely executed by the time the next wiping is required.

Then, from the source of data transfer, such as a computer or leader, image data for one scanning portion (forward scan in the direction indicated by the arrow P1) are transferred to a recording controller (not shown) (step S25). When the data are transferred, the carriage 10 moves further in the direction indicated by the arrow P1, the image is recorded for one scanning portion (step S27) after predischarge is effectuated above the predischarge unit 300 (step S26), and then, the recording medium A is intermittently fed by means of the feed unit 2 just by a recording length L (Step S28).

Here, whether or not the image recording should be terminated is determined (step S29). If affirmative, the carriage 10 is caused to move to the home position, and then, by means of the cap unit 100, capping operation is carried out by the cap unit 100 with respect to the recording heads 11 (step S30), thus terminating the recording operation (step S31).

Meanwhile, if the image recording is to continue, the image data are transferred for the backward movement of the recording heads in the direction indicated by an arrow P2 (step S32), and then, the carriage 10 travels in the direction indicated by the arrow P2 for the execution of image recording at the time of backward movement (step S33). When the image recording is completed for the backward movement, the recording medium A is intermittently fed as in the step S28 (step S34).

Then, whether or not the image recording should be terminated is again determined (step S35). If affirmative, the carriage 10 is allowed to move to the home position, and then, by means of the cap unit 100, capping is performed with respect to the recording head 11 (step S30) to terminate the recording operation (step S31). If the image recording should be continued, it is determined whether or not the pressurized ink feed is needed for the number of scans that have been carried out (step S36). If affirmative, the carriage 10 is caused to move above the cap unit 100 for the execution of pressurized ink feed in the step S23 to which the process will return. Then, operations in the step S24 and on will be repeated. On the other hand, if it is negative, the carriage 10 is caused to move above the blade unit 200 for the execution of wiping, and then, omitting the steps S37, S38, and S39, the operations in the step S25 and on will be repeated.

Fifth Embodiment

Figure 19:
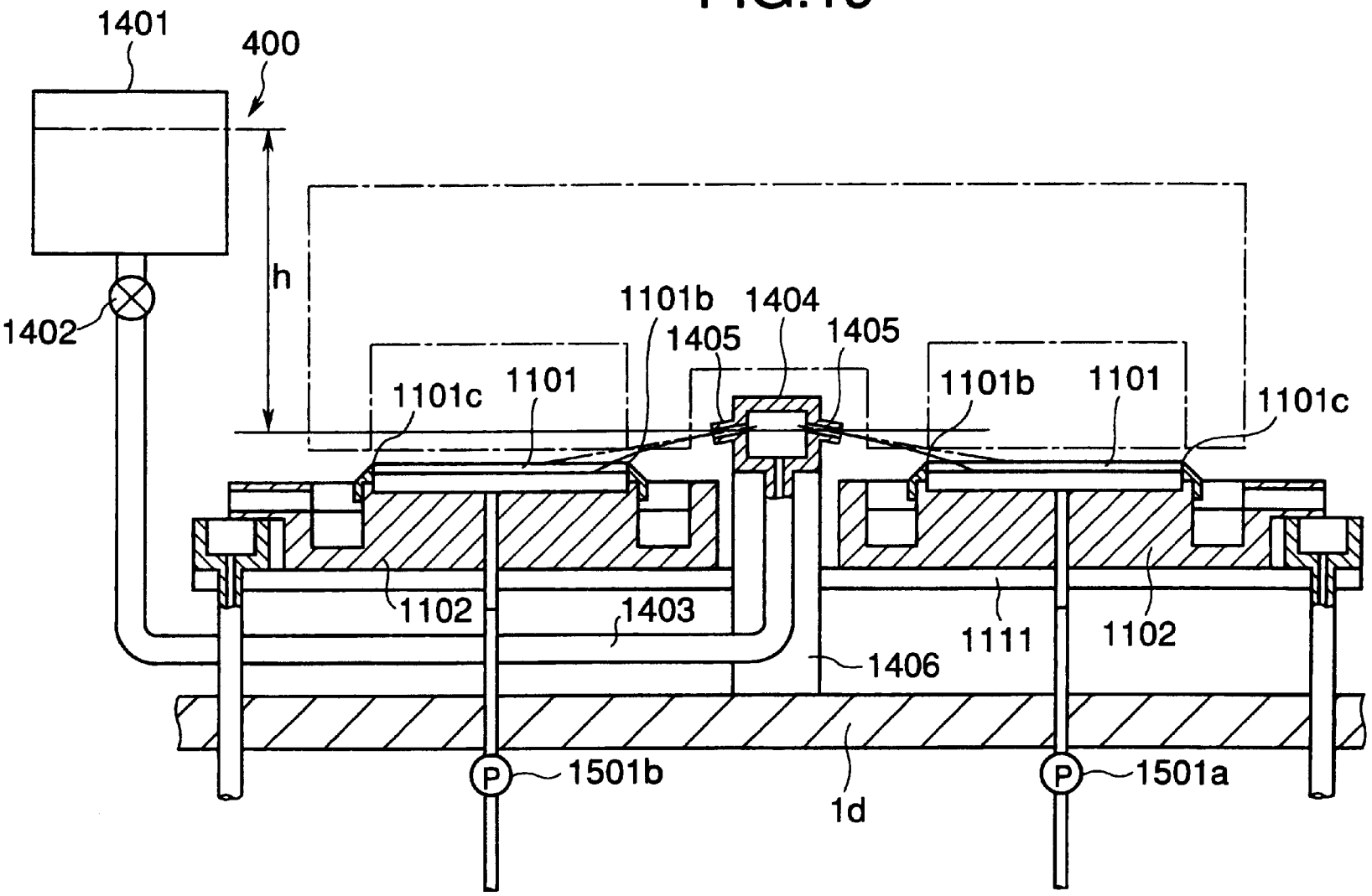
FIG. 19 is a view which illustrates the supporting structure of rinsing liquid supply means for a printing apparatus in accordance with a fifth embodiment of the present invention.

FIG. 19 is a view showing the example in which the supporting structure of the manifold 1404 is different. The supporting base 1406 is not the supporting board 1111 of the holder 1102, but the manifold is fixed to the bottom board 1d that supports the recovery device of the printer unit 1. It is fixed without any relationship with the up and down motion of the caps. The up and down motion of the caps, particularly when capping and the release of capping should be performed at high speeds, the vibration resulting from such quick motion tends to be transmitted to the rinsing nozzles 1405 if the supporting base 1406 is fixed to the supporting board 1111 as shown in FIG. 16, thus rinsing liquid drops off from the leading end of each of the rinsing nozzles 1405 in some cases. This tendency can be prevented by fixing the manifold as in the present embodiment.

The channel position of rinsing liquid is set so that the rinsing liquid flows from the vicinity of the end portion 1011 when the caps are released.

Sixth Embodiment

Figure 20:
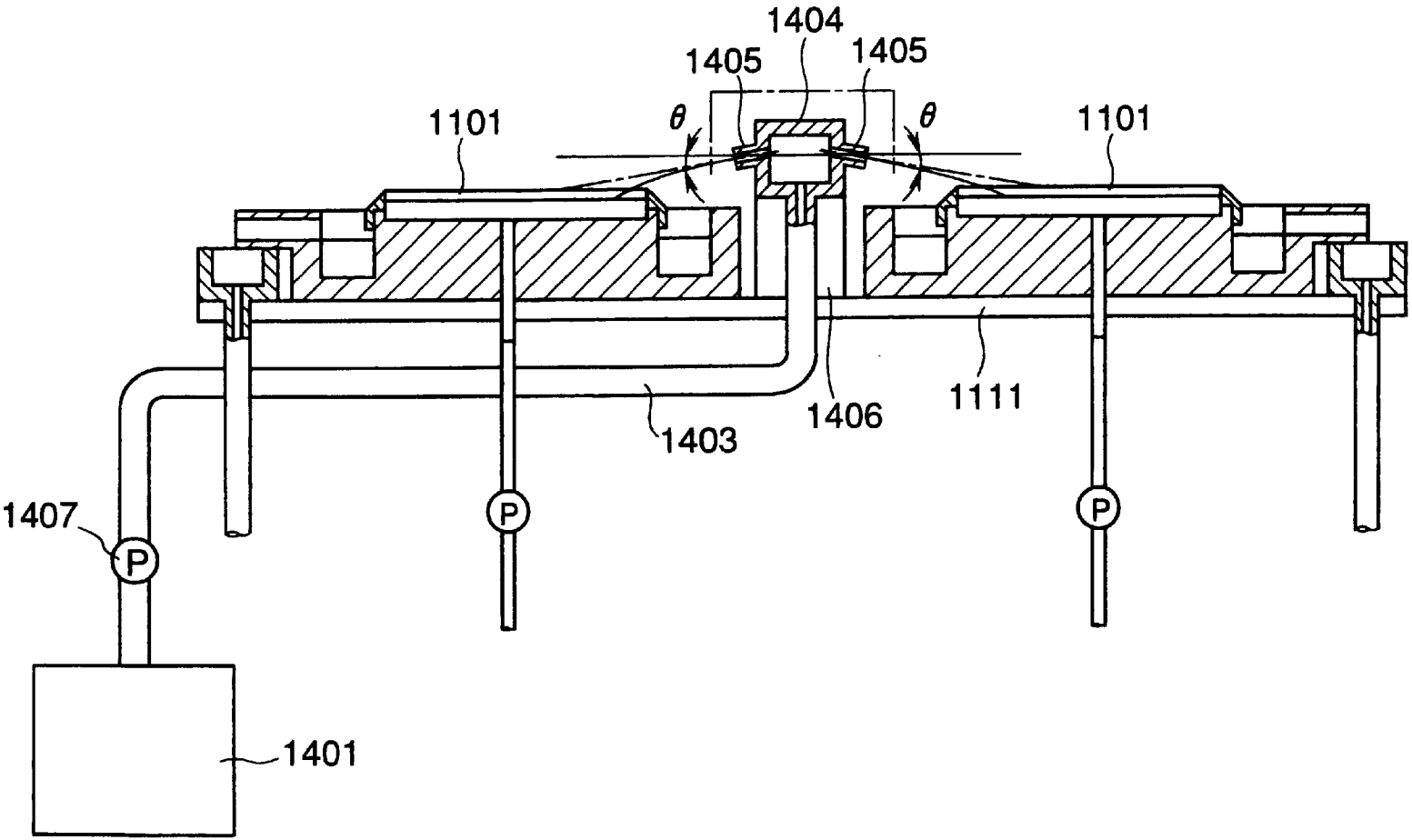
FIG. 20 is a view which illustrates liquid supply means for the rinsing liquid for a printing apparatus in accordance with a sixth embodiment of the present invention.

FIG. 20 shows the example in which the pump 1407 is used as means for feeding rinsing liquid. In order to use the electromagnetic valve 1402 instead of the free falls by the application of difference h in water head, rinsing liquid is supplied by means of the pump 1407 to the manifold 1404. The tank 1401 is positioned below the printer unit 1. As a pump of the kind, either a quantitative pump or a constant pressure pump may be adoptable. The amount of rinsing liquid is set by the driving time of the pump to be used.

Seventh Embodiment

Figure 21:
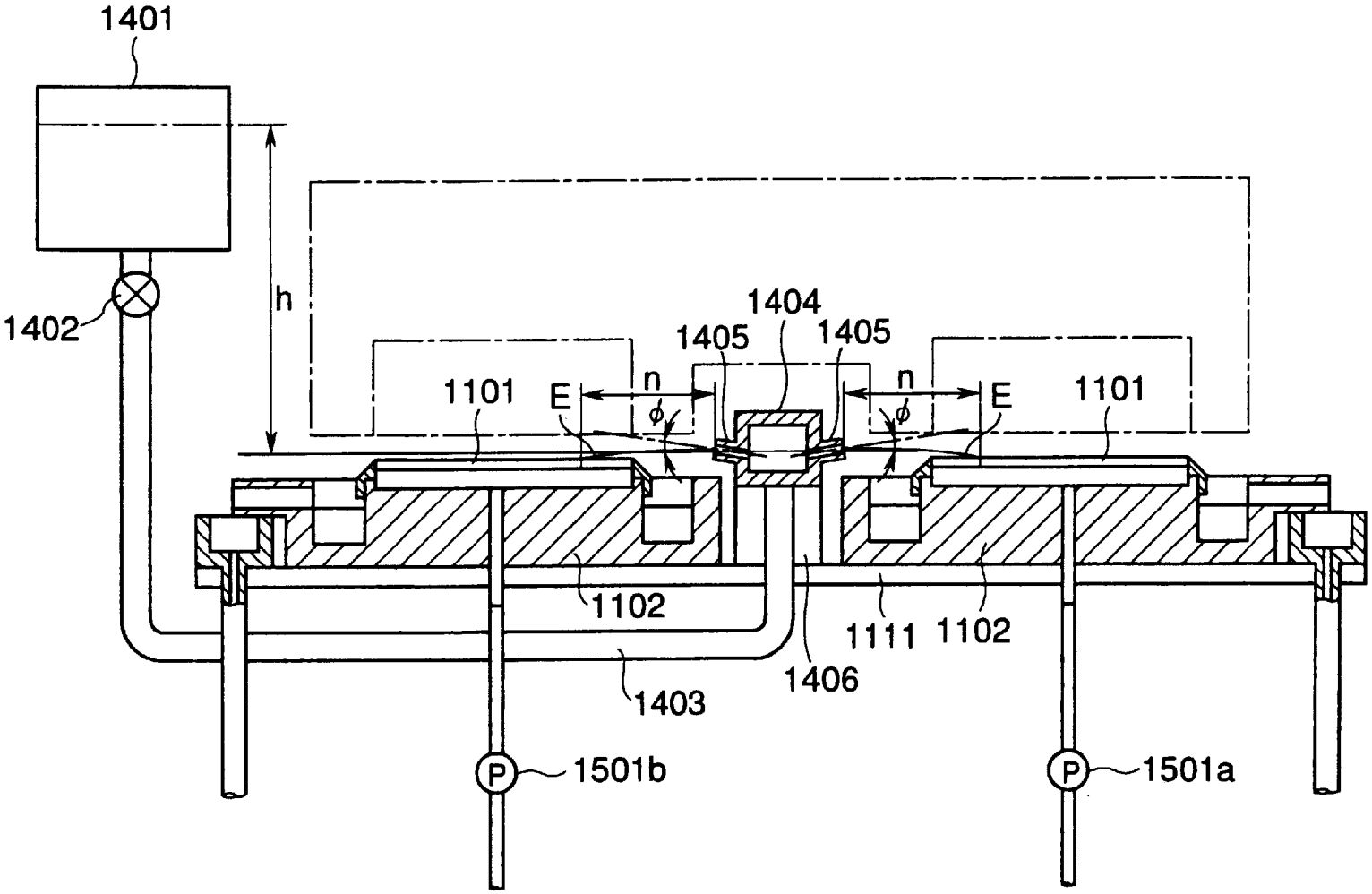
FIG. 21 is a view which illustrates liquid supply means for the rinsing liquid for a printing apparatus in accordance with a seventh embodiment of the present invention.

FIG. 21 shows the example in which the rinsing nozzles 1405 are arranged at an angle of elevation Φ. With the angle of elevation Φ, the flying distance of rinsing liquid is made greater even when its flowrate is smaller at each outlet of the rinsing nozzles 1405. Thus it becomes possible to make the difference h in water head smaller, and make the manifold 1404 smaller by setting the distance between the rinsing nozzles 1405 and caps 1101 longer. Also, each outlet of the rinsing nozzles 1405 is set upwardly. Therefore, the structure can be arranged to make it difficult for the rinsing liquid to drop off from the nozzles with respect to the up and down motion of the caps. As in the case described in conjunction with FIG. 20, it may be possible to supply rinsing liquid by means of the pump 1407.

What is claimed is:

1. An image formation apparatus having a recording head with discharge ports for discharging ink for formation of images, the apparatus comprising:

a cap having a surface portion for contacting the head to cover the discharge ports and having an interior and an exterior;

rinsing liquid supply means for supplying rinsing liquid for rinsing said cap, said rinsing liquid supply means including a rinsing liquid retaining portion for retaining rinsing liquid, and rinsing liquid paths connecting said rinsing liquid retaining portion with said cap to conduct rinsing liquid retained in said rinsing liquid retaining portion into said cap; and a rinsing liquid receptacle arranged to surround said cap for receiving and retaining said rinsing liquid, wherein the surface portion of said cap contacting the head is rinsed out by overflowing rinsing liquid from said cap by use of said rinsing liquid supply means, and the ink is discharged from the discharge ports almost downwardly in a vertical direction.

2. An image formation apparatus according to claim 1, wherein said rinsing liquid supply means further includes a discharge portion for discharging rinsing liquid retained in said rinsing liquid retaining portion onto said cap.

3. An image formation apparatus according to claim 1, wherein an absorbent is arranged adjacent to said cap outside said cap.

4. An image formation apparatus according to claim 3, wherein said absorbent has an end portion, and the end portion is immersed in rinsing liquid in said rinsing liquid retaining portion.

5. An image formation apparatus according to claim 1, wherein an absorbent is arranged in said cap.

6. An image formation apparatus according to claim 1, wherein a pump is conductively connected with the interior of said cap.

7. An image formation apparatus according to claim 1, wherein the ink is discharged from the discharge ports using thermal energy.

8. An image formation apparatus according to claim 7, wherein heat energy generating means are provided for generating said thermal energy.

9. An image formation apparatus according to claim 8, wherein said heat energy generating means are electrothermal transducing elements.

10. An image formation apparatus according to claim 1, further comprising:

an absorbent arranged in said cap for absorbing as required the ink forced out from the recording head; and suction means for sucking liquid from the interior of said cap, wherein the discharge ports are arranged on a discharge port surface of the recording head, and said cap is arrange outside a recording area of the recording head to close the discharge port surface when recording is at rest.

11. An image formation apparatus according to claim 10, wherein said cap is provided with communicating means for conductively connecting the interior of said cap with the exterior thereof.

12. An image formation apparatus according to claim 11, wherein opening and closing means is connected to said communicating means for opening or closing said communicating means arbitrarily.

13. An image formation apparatus according to claim 10, further comprising:

a receptacle for receiving and retaining liquid, said receptacle having an interior and being formed on a circumference of said cap and positioned lower than the surface portion of said cap contacting the recording head; and exhausting means for exhausting liquid from the interior of said receptacle.

14. An image formation apparatus according to claim 13, wherein an another absorbent having a first end and a second end is arranged outside said cap, the first end of said another absorbent being positioned in a vicinity of the surface portion of said cap member contacting the recording head, and the second end of said another absorbent being immersed in liquid retained in said receptacle.

15. An image formation apparatus according to claim 1, further comprising:

a predischarge unit having an interior and arranged outside a recording area of the recording head, said predischarge unit being provided an absorbent in the interior of said predischarge unit for absorbing ink discharged from the recording head as required apart from ink discharged for recording, said absorbent being arranged in a portion of said predischarge unit which is a retaining portion for retaining liquid;

an additional rinsing liquid supply means for supplying rinsing liquid into an interior of said retaining portion; and exhausting means for exhausting liquid from the interior of said retaining portion.

16. An image formation apparatus according to claim 15, wherein said additional rinsing liquid supply means and said exhausting means are positioned to face each other with said absorbent therebetween.

17. An image formation apparatus according to claim 15 or claim 10, wherein the recording head is provided with electrothermal transducing elements for generating thermal energy for discharging the ink.

18. An image formation apparatus according to claim 17, wherein the recording head discharges the ink from the discharge ports using film boiling created in the ink by the thermal energy generated by said electrothermal transducing elements.

19. An image formation apparatus according to claim 1, further comprising:

rinsing means, arranged adjacent to said cap and provided with a liquid discharge unit positioned higher than said cap, for discharging the rinsing liquid onto said cap; and exhausting means for exhausting the rinsing liquid, wherein the discharge ports are arranged on a discharge port surface of the recording head, and said cap includes means for closing the discharge port surface to forcibly exhaust liquid therefrom and suck liquid thus exhausted, and wherein said rinsing means is arranged in a position higher than said cap and said liquid discharge unit, and said rinsing liquid retaining portion supplies the rinsing liquid to said liquid discharge unit.

20. An image formation apparatus according to claim 19, wherein a plurality of said recording heads are provided, and a plurality of said liquid discharge units are arranged one to one for said recording heads.

21. An image formation apparatus according to claim 19, wherein said exhausting means is formed on a circumference of said cap, and provided with a liquid receptacle positioned lower than the surface portion of said cap contacting with the recording head to receive and retain the rinsing liquid, and an exhaust unit for exhausting the rinsing liquid from an interior of said receptacle.

22. An image formation apparatus according to claim 19, further comprising:

wiping means having a wiping unit for wiping said discharge port surface, and rinsing liquid at least for use of the wiping unit of said wiping means, said rinsing liquid being supplied using said rinsing liquid retaining portion.

23. An image formation apparatus according to claim 19, further comprising:

rinsing liquid refilling means for refilling the rinsing liquid in said rinsing liquid retaining portion.

24. An image formation apparatus according to claim 19, wherein said exhausting means exhausts the rinsing liquid in an amount exceeding a predetermined amount when the amount of the rinsing liquid in said receptacle exceeds such predetermined amount.

25. An image formation apparatus according to claim 19, wherein the recording head is a color recording head.

26. An image formation apparatus according to claim 19, wherein said cap and said rinsing means are supported by supporting members different from each other.

27. An image formation apparatus according to claim 19, wherein the recording head is provided with a plurality of nozzles for discharging liquid.

28. An image formation apparatus according to claim 22, wherein the recording head is provided with thermal energy transducing elements for generating thermal energy for discharging the liquid.

29. An image formation apparatus according to either one of claims 15, 10, and 19, wherein the images are formed on a fabric printing medium.

30. An image formation apparatus according to either one of claims 15, 10, and 19, wherein the images are formed on a printing medium, and the printing medium holds liquid discharged by the recording head.

31. An image formation apparatus according to either one of claims 15, 10, and 19, wherein the apparatus is an output terminal of an information processing system.

32. An image formation apparatus according to claim 31, wherein the images are formed on a printing medium, the printing medium is fabric, and said output terminal is a textile printing apparatus for printing by discharging liquid onto said fabric.

33. An image formation apparatus having a recording head with discharge ports for discharging ink for formation of images, the apparatus comprising:

a cap having a surface portion for contacting the head to cover the discharge ports and having an interior and an exterior;

rinsing liquid supply means for supplying rinsing liquid for rinsing said cap, said rinsing liquid supply means including a rinsing liquid retaining portion for retaining rising liquid, and a rinsing liquid path for conducting rinsing liquid retained in said rinsing liquid retaining portion to said cap; and a rinsing liquid receptacle arranged to surround said cap for receiving and retaining said rinsing liquid, wherein the surface portion of said cap contacting the head is rinsed out by overflowing rinsing liquid from said cap by use of said rinsing liquid supply means while said cap is disposed substantially vertically.

34. An image formation apparatus according to claim 33, wherein said rinsing liquid supply means further includes a discharge portion for discharging rinsing liquid retained in said rinsing liquid retaining portion onto said cap.

35. An image formation apparatus according to claim 33, wherein an absorbent is arranged adjacent to said cap outside said cap.

36. An image formation apparatus according to claim 35, wherein said absorbent has an end portion, and the end portion is immersed in rinsing liquid in said rinsing liquid retaining portion.

37. An image formation apparatus according to claim 33, wherein an absorbent is arranged in said cap.

38. An image formation apparatus according to claim 33, wherein a pump is conductively connected with the interior of said cap.

39. An image formation apparatus according to claim 33, wherein the ink is discharged from the discharge ports using thermal energy.

40. An image formation apparatus according to claim 39, wherein heat energy generating means are provided for generating said thermal energy.

41. An image formation apparatus according to claim 40, wherein said heat energy generating means are electrothermal transducing elements.

42. An image formation apparatus according to claim 33, further comprising:

an absorbent arranged in said cap for absorbing as required the ink forced out from the recording head; and suction means for sucking liquid from the interior of said cap, and wherein the discharge ports are arranged on a discharge port surface of the recording head, and said cap is arranged outside a recording area of the recording head to close the discharge port surface when recording is at rest.

43. An image formation apparatus according to claim 42, wherein said cap is provided with communicating means for conductively connecting the interior of said cap with the exterior thereof.

44. An image formation apparatus according to claim 43, wherein opening and closing means is connected to said communicating means for opening or closing said communicating means arbitrarily.

45. An image formation apparatus according to claim 42, further comprising:

a receptacle for receiving and retaining liquid, said receptacle having an interior and being formed on a circumference of said cap and positioned lower than the surface portion of said cap contacting the recording head; and exhausting means for exhausting liquid from the interior of said receptacle.

46. An image formation apparatus according to claim 45, wherein an another absorbent having a first end and a second end is arranged outside said cap, the first end of said another absorbent being positioned in a vicinity of the surface portion of said cap member contacting the recording head, and the other end of said another absorbent being immersed in liquid retained in said receptacle.

47. An image formation apparatus according to claim 33, further comprising:

a predischarge unit having an interior and arranged outside a recording area of the recording head, said predischarge unit being provided with an absorbent in the interior of said predischarge unit for absorbing ink discharged from the recording head as required apart from ink discharged for recording, said absorbent being arranged in a portion of said predischarge unit which is a retaining portion for retaining liquid;

an additional rinsing liquid supply means for supplying rinsing liquid into an interior of said retaining portion; and exhausting means for exhausting liquid from the interior of said retaining portion.

48. An image formation apparatus according to claim 47, wherein said additional rinsing liquid supply means and said exhausting means are positioned to face each other with said absorbent therebetween.

49. An image formation apparatus according to claim 42 or claim 47, wherein the recording head is provided with electrothermal transducing elements for generating thermal energy for discharging the ink.

50. An image formation apparatus according to claim 49, wherein the recording head discharges the ink from the discharge ports using film boiling created in the ink by the thermal energy generated by said electrothermal transducing elements.

51. An image formation apparatus according to claim 33, further comprising:

rinsing means, arranged adjacent to said cap and provided with a liquid discharge unit positioned higher than said cap, for discharging the rinsing liquid onto said cap; and exhausting means for exhausting the rinsing liquid, wherein the discharge ports are arranged on a discharge port surface of the recording head, and said cap includes means for closing the discharge port surface to forcibly exhaust liquid therefrom and suck liquid thus exhausted, and wherein said rinsing means is arranged in a position higher than said cap and said liquid discharge unit, and said rinsing liquid retaining portion supplies the rinsing liquid to said liquid discharge unit.

52. An image formation apparatus according to claim 51, wherein a plurality of said recording heads are provided, and a plurality of said liquid discharge units are arranged one to one for said recording heads.

53. An image formation apparatus according to claim 51, wherein said exhausting means is formed on a circumference of said cap, and provided with a liquid receptacle positioned lower than the surface portion of said cap contacting with the recording head to receive and retain the rinsing liquid, and an exhaust unit for exhausting the rinsing liquid from an interior of said receptacle.

54. An image formation apparatus according to claim 51, further comprising:

wiping means having a wiping unit for wiping said discharge port surface, and rinsing liquid at least for use of the wiping unit of said wiping means, said rinsing liquid being supplied using said rinsing liquid retaining portion.

55. An image formation apparatus according to claim 51, further comprising:

rinsing liquid refilling means for refilling the rinsing liquid in said rinsing liquid retaining portion.

56. An image formation apparatus according to claim 51, wherein said exhausting means exhausts the rinsing liquid in an amount exceeding a predetermined amount when the amount of the rinsing liquid in said receptacle exceeds such predetermined amount.

57. An image formation apparatus according to claim 51, wherein the recording head is a color recording head.

58. An image formation apparatus according to claim 51, wherein said cap and said rinsing means are supported by supporting members different from each other.

59. An image formation apparatus according to claim 51, wherein the recording head is provided with a plurality of nozzles for discharging liquid.

60. An image formation apparatus according to claim 59, wherein the recording head is provided with thermal energy transducing elements for generating thermal energy for discharging the liquid.

61. An image formation apparatus according to either one of claims 42, 47, and 51, wherein the images are formed on a fabric printing medium.

62. An image formation apparatus according to either one of claims 42, 47, and 51, wherein the images are formed on a printing medium, and the printing medium holds liquid discharged by the recording head.

63. An image formation apparatus according to either one of claims 42, 47, and 51, wherein the apparatus is an output terminal of an information processing system.

64. An image formation apparatus according to claim 63, wherein the images are formed on a printing medium, the printing medium is fabric, and said output terminal is a textile printing apparatus for printing by discharging liquid onto said fabric.

* * * * *